US011879335B2

(12) United States Patent
Blange

(10) Patent No.: US 11,879,335 B2
(45) Date of Patent: Jan. 23, 2024

(54) METHOD AND SYSTEM FOR DIRECTIONAL DRILLING

(71) Applicant: Canopus Drilling Solutions Holding B.V., The Hague (NL)

(72) Inventor: Jan Jette Blange, 's-Gravenhage (NL)

(73) Assignee: Canopus Drilling Solutions Holding B.V., The Hague (NL)

( * ) Notice: Subject to any disclaimer, the term of this patent is extended or adjusted under 35 U.S.C. 154(b) by 0 days.

(21) Appl. No.: 17/768,191

(22) PCT Filed: Oct. 9, 2020

(86) PCT No.: PCT/EP2020/078467
§ 371 (c)(1),
(2) Date: Apr. 11, 2022

(87) PCT Pub. No.: WO2021/069694
PCT Pub. Date: Apr. 15, 2021

(65) Prior Publication Data
US 2023/0160263 A1 May 25, 2023

(51) Int. Cl.
*E21B 7/18* (2006.01)
*E21B 17/18* (2006.01)
*E21B 21/12* (2006.01)

(52) U.S. Cl.
CPC ..... *E21B 7/18* (2013.01); *E21B 17/18* (2013.01); *E21B 21/12* (2013.01)

(58) Field of Classification Search
CPC ... E21B 7/16; E21B 7/18; E21B 17/18; E21B 21/12
See application file for complete search history.

(56) References Cited

U.S. PATENT DOCUMENTS 4,768,709 A * 9/1988 Yie ..... B24C 5/02 239/336
6,702,940 B2 * 3/2004 Blange ..... B65G 54/02 451/87
2012/0255791 A1 10/2012 Blange et al.
2012/0255792 A1 * 10/2012 Blange ..... E21B 7/18 175/424
2013/0292181 A1 * 11/2013 Blange ..... E21B 7/065 175/73

* cited by examiner

*Primary Examiner* — David Carroll
(74) *Attorney, Agent, or Firm* — The Watson IP Group, PLC; Jovan N. Jovanovic

(57) ABSTRACT

The invention relates to variation of concentrations of abrasive particles in a stream of drilling fluid mixed with abrasive particles, passed as an abrasive jet through abrasive nozzle(s) of a drill bit along rotations thereof, to vary the erosive power of the stream along angular sections of the borehole for directional drilling. During subsequent time periods majorities of abrasive particles are alternately deflected into two parallel channels with a different flow resistance. A resulting velocity difference between said majorities makes that the subsequently deflected majorities recombine downstream of the channels, so that high concentration stream portions of the combined majorities are formed which alternate low concentration stream portions. Synchronising the frequency of the stream portions with the rotational velocity of the drill bit results in a consistently higher erosive power of the abrasive jet within a selected angular section of the borehole than outside thereof.

24 Claims, 6 Drawing Sheets

◀ Fig. 2

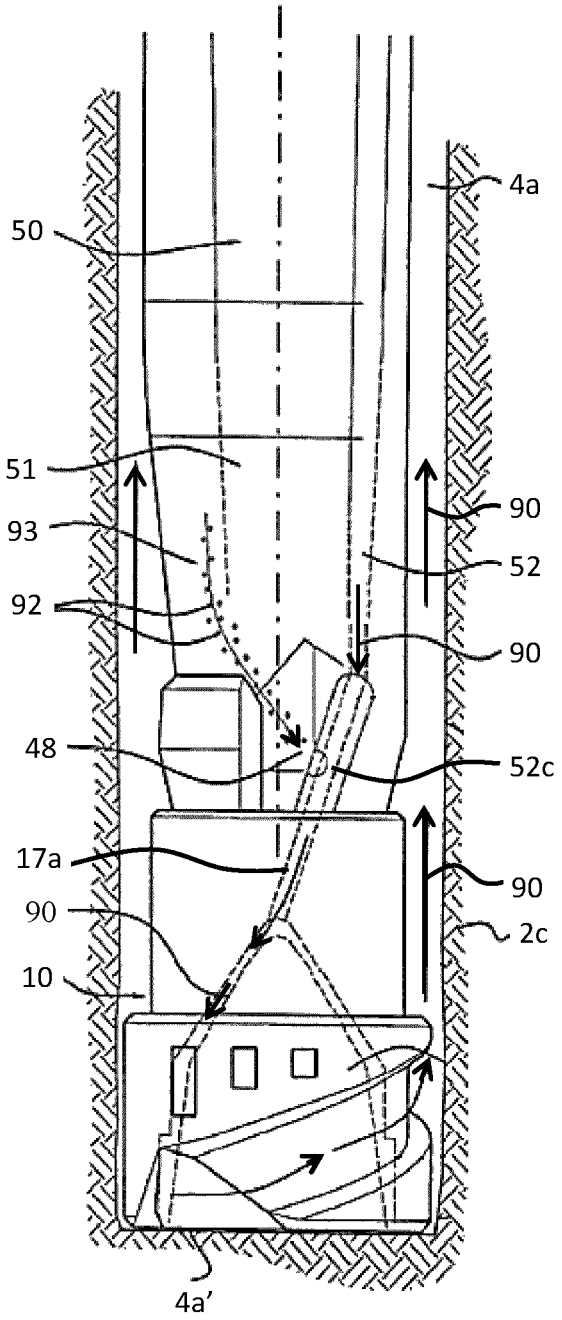
▲ Fig. 7

METHOD AND SYSTEM FOR DIRECTIONAL DRILLING

FIELD OF THE INVENTION

The present invention relates to the field of drilling into an object, in particular into an earth formation, e.g. a subterranean earth formation. In particular, the present invention provides a method and system of directional mechanical drilling of a borehole into said object.

Directional mechanical drilling involves drilling into said object around a bend, producing curved borehole sections therein. This enables to establish a borehole trajectory in said object with one or more curved sections, e.g. adjoined by straight borehole sections which, as a consequence, extend at a mutual angle. The ability to produce a borehole with such curved trajectories in subterranean earth formations allows in practice e.g. to drill into a subterranean reservoir in a non-vertical direction, e.g. in a slanted or even horizontal direction. For the purpose of directional drilling, drilling equipment is used which is capable of removing material at the end of a borehole in an intended direction that is slanted with respect to the directly preceding direction of the borehole. Performing directional drilling continuously over a certain borehole length produces a tangent or curved predetermined borehole trajectory.

During directional drilling, the drilling direction is carefully controlled so as to establish the intended curved trajectory. In practice, most directional drillers for subterranean earth formations are given a well path to follow that is predetermined by engineers and geologists before the drilling commences. When the directional driller starts the drilling process, periodic surveys are taken with a downhole instrument to provide survey data, e.g. inclination and azimuth, of the well bore. During critical angles and direction changes a measurement-while-drilling tool (MWD-tool) is often added to the drill string to provide continuously updated measurements that may be used for (near) real-time adjustments. This data indicates if the well is following the planned path and whether the orientation of the drilling assembly is causing the well to deviate as planned.

In some conventional drilling processes, after drilling a straight vertical borehole section, the drill string is firstly to be pulled to replace the bottom hole assembly (BHA) for straight drilling with a specialized directional drilling BHA. After directional drilling until completion of the curved section, the straight and directional drilling BHAs are interchanged again, in case straight drilling is to recommence from the end of the curved section, therein again rotating the drill string.

Common drilling equipment for directional drilling encompasses bent subs, mud motors, and rotating seals. When using this equipment, only the downhole part of the drill string rotates while drilling a curved section of a borehole—driven by a separate motor. The non-rotating drill string is therein slid further into the hole. In these drilling processes, the same BHA with a bent sub is used for both straight and curved borehole sections. To drill a straight section, the string is rotated along with the drill bit.

Among others to avoid a required interchange of BHAs and/or a sliding of the drill string through the borehole, more recent equipment involves rotary steerable systems (RSS), which are in drilling a curved borehole section capable of operating while the entire drill string rotates. These systems point the drill bit into the intended, with respect to the directly preceding borehole direction slanted, drilling direction, or push the drill bit towards it by means of expandable thrust pads. The deviation of the borehole in the intended direction may be achieved by a side-cutting ability of the drill bit—e.g. employing cutters at the side of conventional polycrystalline diamond compact (PDC) drill bits in addition to the front end cutters.

BACKGROUND OF THE INVENTION

When using a drill bit of the type that forms a cylindrical sidewall, a drill face and a circumferentially extending gage corner, directional drilling is generally achieved by having rotary drilling equipment remove predetermined different amounts of the gage corner material at the borehole bottom over selected angular sectors of the borehole bottom during each rotation of the drill bit. Therein a smaller amount of material is removed in an angular sector in an intended, relatively slanted, drilling direction than in the remaining angular sector of the borehole bottom. As a consequence, slight lateral forces on the drill bit by the former angular sector force the drill bit in the intended direction. When applying this technique continuously over a certain borehole length, a curved borehole section is produced over this borehole length with a radius depending on the difference between removed amounts at the angular sectors of the borehole bottom.

The difference between the amounts of removed material at the angular sectors of the borehole bottom may therein be achieved by purposely controlling the flow of drilling fluid through jets in the bit, varying this flow during each rotation such as to create a difference between the effectiveness of the drill bit at the angular sectors.

To achieve this control of the drilling fluid flow, U.S. Pat. No. 4,637,479 proposes to sequentially open and close the jets in the bit as the bit rotates. During rotation of the drill string with drill bit, fluid communication through nozzles outside a predetermined angular sector of the borehole bottom at the side of the borehole of the intended drilling direction is always allowed, while being blocked inside said angular sector. Consequently the jets only operate outside said angular sector, improving in that sector the cutting by the bit—and deviating thereby the path of the drill bit in the intended direction—towards said angular sector.

U.S. Pat. No. 4,211,292 proposes, for a roller cone drill bit, to extend one of the nozzles at a position normally occupied by a conventional wash nozzle with a fluid jet emitting nozzle. This extended jet nozzle emits pressurized fluid onto the gage corner of the borehole being drilled. Pressurized fluid is selectively conducted to the jet emitting nozzle only during a predetermined partial interval of each drill bit rotation, so as to increase cutting of the borehole bottom outside a selected angular sector of the borehole and deviate the borehole towards that angular sector.

GB2284837 discloses a roller cone drill bit with three nozzles in between the cones, of which one nozzle is adapted to direct the flow of drilling fluid into the corner of the bit face, so that said flow is asymmetric relative to the bit. The flow of drilling fluid is pulsed, and synchronized with the rotation frequency of the adapted nozzle. Thereby the fluid flow is high when the adapted nozzle is azimuthally directed—that is, at an angular position with respect to a tangentially directed axis central through the borehole at the borehole bottom—outside a selected angular sector of the borehole, and low for the remainder of the rotation of the drill bit—deviating the path of the drill bit towards the selected angular sector.

Particular systems for straight and directional drilling employ abrasive particles mixed with drilling fluid to remove the material at the end of the borehole. Such a system comprises jet means for generating an abrasive jet of said mixture and blasting this jet with an erosive power into impingement with the object in an impingement area of the borehole bottom, in particular at the gage corner of a borehole, thereby (further) eroding the object in the impingement area. The drill string is therein provided with a longitudinal passage for transporting to the drill head a drilling fluid mixture which comprises abrasive particles.

Directional drilling can be achieved with these systems by modulating the erosive power of the abrasive jet, e.g. by modulating the velocity of the abrasive particles and/or the mass flow rate thereof as the drill bit rotates, in synchronisation with the rotational velocity of the drill bit.

The abrasive jet may be applied in combination with mechanical cutters, e.g. by means of abrasive jet nozzles on a PDC or tricone bit in addition to the wash nozzles, so that the drilling is achieved both by means of cutting and abrasive jetting.

The abrasive jet may in particular be applied in a dedicated abrasive jet drill head, mounted on a lower end of a drill string. This drill head comprises the jet means arranged to generate an abrasive jet in a jetting direction into impingement with the object in an impingement area, and one or more nozzles guiding the jet—the drill head being devoid of mechanical cutters so that the drilling is achieved by said impingement only.

The abrasive jet, applied in either a combined or dedicated system, may advantageously contain magnetic abrasive particles, e.g. magnetic particles only. These particles may for instance have the form of a steel shot. The use of magnetic abrasive particles enables to improve the control of the flow of the abrasive particles by employing magnetic fields acting on said particles.

Typically these particles are ferromagnetic, e.g. martensitic steel and have a residual magnetization, in particular in view of transportability through the usually ferromagnetic conduits like drill pipe.

The improved control by magnetism e.g. advantageously enables a downhole recirculation system for the abrasive particles, wherein, after erosive impingement of the abrasive particles, a magnet provided in the drill string above the bit, e.g. in the sub bit, captures the particles from a return stream of the mixture of drilling fluid and the particles towards the surface, which flows upwardly in between the drill string and the borehole wall. After the capturing thereof, the abrasive particles are transported through the drill string in a downhole direction to a mixing location, where they are remixed with a fresh mixture of drilling fluid and abrasive particles supplied via the drill string from the surface.

WO2008/119821 discloses such a recirculation system, which for the purpose of capturing and transporting the abrasive particles employs a static magnet. This magnet attracts the abrasive particles from the return stream at the upper side of the magnet, after which these move over a sloping surface in the direction of the drill bit again, to in a mixing chamber subsequently be mixed with the fresh mixture of drilling fluid and abrasive particles supplied through the drill string.

Magnetic fields may be utilized as well to manipulate the erosive power of the abrasive particles, e.g. through the velocity and/or mass flow rate thereof, and thus be used to achieve directional drilling, and directional control thereof, by selectively varying the erosive power along the impingement area.

The prior art discloses several solutions for manipulating the erosive power of magnetic abrasive particles along the impingement area for the purpose of directional drilling.

The system disclosed in WO2005/005767 employs the magnetic fields of its recirculation system for the magnetic abrasive particles in order to modulate the erosive power of the abrasive jet. Therein the magnet of the recirculation system is arranged as a rotatable conveyor, attracting the abrasive particles to be recycled at an upper side thereof and conveying these towards the mixing chamber. A modulation means in the form of a controllable drive means for the conveyor is arranged so as to modulate the recirculation rate, and, thereby, the quantity of abrasive particles in the abrasive jet at the jet means, in synchronisation with the rotational velocity of the nozzles of the drill bit. Thereby, the erosive power is varied along angular sections of the borehole bottom. Reference is also made in this regard to WO2005/05766.

This prior art solution is not entirely satisfactory, as the modulation is based on, and therefore requires the presence of, the rotatable magnetic conveyor of the recirculation system. Maintaining a rotating magnetic field downhole not only utilizes a significant amount of energy, but is disadvantageous as well for necessitating continuously moving parts at that location, compromising the robustness of the system. Use of a recirculation system such as disclosed in WO2008/119821, with a static magnet, would in view of the latter generally be more preferred in directional drilling systems employing magnetic abrasive particles. However, this would take away the possibility for said modulation.

To solve this problem, US2012/0255792 and US20130292181 propose to modulate the erosive power of the abrasive particles independently of the recirculation system. The disclosed systems thereto modulate the concentration of the magnetic abrasive particles in the mixture with the drilling fluid being supplied to the nozzles.

The system of US2012/0255792 accomplishes this in a dedicated abrasive jet drill bit with a single nozzle, by capturing the magnetic particles on a magnetically activated particle collection surface. This collection surface is arranged along a passageway for the drilling fluid mixture towards the bit. The magnetic field on the collection surface is manipulated such that the surface sequentially captures magnetic particles from, and releases them into, the fluid mixture. The nozzle is rotated at a selected rotational frequency, and said modulation of the supply concentration by means of the capture and release of the particles at the collection surface is modulated at a modulation frequency that is equal to, or an integer fraction of, this rotational frequency. As a result a single jet nozzle can selectively blast decreased or increased jetting concentrations of abrasive particles at certain angular positions in the borehole.

However, this solution turns out to not be satisfactory either. The magnetic abrasive particles typically move with a high velocity—in particular, much higher than 2 m/s—so that the system still requires a high energy supply, in this case for catching the particles. Furthermore, a long interaction length is needed for the capturing of the particles.

The system of US20130292181, provides an alternative solution, and comprises a plurality of nozzles in the drill bit. The magnetic abrasive particles are geostationary diverted, by a controlled magnet or another means—in particular by sequential alignment of supply channels of each nozzle with the outlet of a geostationary flow diverter means along each rotation of the drill bit.

This solution entails similar disadvantages as that of US2012/0255792. In order for the flow diversion to be geostationary, while the drill bit rotates, the rotation of the drill bit with the nozzles must be compensated for the flow diverter. This requires bearings and an advanced control mechanism inside a rotating tube. Also, the energy required for the rotational compensation still disadvantageously requires a high energy supply.

In conclusion of the above, in order to accomplish the controlled flow of drilling fluid, e.g. mixed with abrasive particles, e.g. magnetic abrasive particles, for the purpose of directional drilling, the currently known technology thus requires substantial modifications to conventional drill bits, such as nozzle modifications (e.g. U.S. Pat. No. 4,211,292, GB2284837) or the implementation of rotating seals and/or bearings (e.g. U.S. Pat. No. 4,637,479, US2012/0255792, US20130292181), and/or an undesirably high energy demand by downhole parts (e.g. WO2005/005767, US2012/0255792, US20130292181).

Modifications are undesirable, as that reduces the choice of drill bit for the driller and requires use of such drill bit also for straight parts of the borehole trajectory. Modifying nozzles in conventional drill bits will moreover reduce overall drilling performance, as will the blocking nozzles (e.g. U.S. Pat. Nos. 4,637,479, 4,211,292). Rotating seals and bearings are vulnerable and for that reason not a desired option in downhole parts. The use of actively moving, in particular rotating, parts downhole are neither preferred as it makes the system more vulnerable (e.g. WO2005/05766, US20130292181).

OBJECT OF THE INVENTION

A high energy demand by downhole parts requires a downhole power supply, e.g. in the form of batteries or a down hole power generator. This is an awkward complication of any system given the harsh downhole environment.

A first object of the present invention is to provide at least an alternative for the presently known systems and methods for directional drilling.

A second object of the present invention is to provide a controlled flow of abrasive particles, e.g. magnetic abrasive particles, within a drilling fluid flow for directional drilling, that forms a suitable alternative for the presently known systems and methods.

A third object of the present invention is to provide a system and method for establishing a controlled flow of abrasive particles, e.g. magnetic abrasive particles, within a drilling fluid flow for directional drilling, that is more robust than the presently known systems and methods.

A fourth object of the present invention is to provide a system and method for establishing a controlled flow of magnetic abrasive particles within a drilling fluid flow for directional drilling, that involves a lower downhole energy supply than the presently known systems and methods.

SUMMARY OF THE INVENTION

To this end, in a first aspect thereof, the present invention provides a method and a system.

A method for directional drilling of a borehole according to the invention comprises:

providing a drill bit, said drill bit being connected to a lower end of a drill string and comprising:

a bit face, which during use faces the borehole bottom, one or more abrasive jet nozzles configured for directing a stream of drilling fluid mixed with abrasive particles into impingement with the borehole bottom in the form of an abrasive jet, which abrasive jet nozzles, if in plural, are arranged at different adjacent azimuthal positions, an intermediate space between a bit fluid inlet port of the drill bit and said one or more abrasive jet nozzles, each of the one or more abrasive jet nozzles having a nozzle inlet for fluid communication with the intermediate space, from which each of the nozzle inlets extends;

upstream of said bit fluid inlet port, passing the stream of drilling fluid mixed with abrasive particles, through a supply channel having an supply channel outlet at a substantially constant supply velocity, simultaneously, rotating the drill bit, and thereby the one or more abrasive jet nozzles, at a rotational velocity while passing said stream of drilling fluid mixed with abrasive particles via the supply channel outlet and the bit fluid inlet port consecutively through the intermediate space, the one or more nozzle inlets, and the one or more abrasive jet nozzles into impingement with the borehole bottom, so as to deepen the borehole; and during said rotating of the drill bit while passing of the stream of drilling fluid mixed with abrasive particles, varying concentrations of said abrasive particles along subsequent stream portions of said stream flowing through the abrasive jet nozzles of the drill bit, such that alternatingly the concentration of abrasive particles is high in a first stream portion and low in a subsequent second stream portion.

According to the invention, said varying of the concentrations of the abrasive particles in the stream of drilling fluid mixed with abrasive particles comprises:

upstream of said bit fluid inlet port, passing said stream from the supply channel outlet subsequently, in parallel through a first channel and a second channel to first and second outlets thereof, respectively, and from the first and second outlets into the bit fluid inlet port, while, alternatingly, during a first time period, deflecting into the first channel a majority of all abrasive particles in the stream that pass through the supply channel outlet, and during a second time period, following the first time period, not deflecting into the first channel a majority of all abrasive particles in the stream that pass through said supply channel outlet, and subsequently passing said stream from the first and second outlets into said one or more abrasive jet nozzles, wherein the difference between a flow resistance to said drilling fluid mixed with abrasive particles in said first channel and a flow resistance to said drilling fluid mixed with abrasive particles in said second channel results in a difference between a first velocity at which said drilling fluid mixed with abrasive particles flows through said first channel and a second velocity at which said drilling fluid mixed with abrasive particles flows through said second channel, wherein said difference between said first and second velocities is such that, downstream of the first and second outlets, the majority deflected into the first channel during the first time period and the abrasive particles passed into the second channel during the second time period, together with said drilling fluid passed into the first and second channel during the first and second time period, respectively, are combined to form the first stream portion, and the abrasive particles passed into the first channel during the second time period and the abrasive particles passed into the second channel during a first time period following the second time period together with drilling fluid passed into the first and second channel during the second time period and the first time period following the second time period, respectively, form the second stream portion.

According to the claimed invention, the flow of drilling fluid is split into two sub flows. A first sub flow that passes through a first channel, and a second sub flow that passes through a second channel. The first channel and the second channel have different flow resistances, such that one of the sub flows takes longer to pass through the respective channel than the other sub flow. Furthermore, at time intervals, particles in the flow of drilling fluid are deflected into the first sub flow at the entry of the first and second sub channel. Thus, during a first time period the concentration of particles in the first sub flow is increased, while the concentration of particles in the second sub flow is reduced. During a subsequent second time period, the particles are not deflected into the first channel. In this way, each sub flow is provided with flow sections having a high particles concentration alternated with flow sections having a low particles concentration.

The lengths of the first and second time period, and the first and second sub channel, are configured such that, when the sub flows are recombined into a single flow at the exit of the first and second channel, the flow sections with a high particle concentration of the first sub flow at least partially, preferably substantially fully, overlap with the flow sections with a high particle concentration of the second sub flow. Thus, the single flow, resulting from the combination of the first and second sub flow, also comprises flow sections with a low particle concentration alternated with flow sections having a high particle concentration, wherein the high particle concentration is larger than the particle concentration in the flow prior to being split into two sub flows, and the low particle concentration is less than the particle concentration in the flow prior to being split into two sub flows.

Furthermore, deflecting is timed such that the increased concentration of abrasive particles is in sync with rotation of drill bit. More in particular, the deflecting is timed such that the increased concentration of abrasive particles flows through the one or more abrasive jet nozzles, when these one or more abrasive jet nozzles, more in particular the flow that passes through those one or more abrasive jet nozzles, is directed towards a section of the bore hole, more in particular the bottom of the bore hole, that requires enhanced erosive power to propagate deflection of the drilling direction and thus a curved drilling trajectory. In a preferred method, during the second time period, particles are deflected into the second channel, thus increasing the particle concentration in the second sub flow while, not deflecting into the first channel, thus reducing the particle concentration in the first sub flow.

Thus, according to the invention, stream portions with alternatingly high and low concentrations of abrasive particles are created by passing drilling fluid comprising abrasive particles through two channels that have different flow resistances, and by a controlled periodical passing of a majority of abrasive particles through one of said two channels, preferably by controlled passing of a majority of abrasive particles alternatingly through a first and a second channel.

In an embodiment of the method according to the invention, the varying of the concentrations of the abrasive particles in the stream of drilling fluid mixed with abrasive particles comprises:

during the first time period, deflecting into the first channel a first majority of all abrasive particles in the stream that pass through the supply channel outlet, and during the second time period following the first time period, deflecting into the second channel a second majority of all abrasive particles in the stream that pass through said supply channel outlet, and subsequently passing said stream from the first and second outlets into said abrasive jet nozzles.

Therein, the difference between the first and second velocities is such that, downstream of the first and second outlets, the first and second majority deflected into the first channel during the first time period and deflected into the second channel during the second time period, together with said drilling fluid passed into the first and second channel during the first and second time period, respectively, are combined to form the first stream portion. The minorities of abrasive particles not being deflected together with drilling fluid passed into the first and second channel during the second and first time period, respectively, form the second stream portion.

Thus, according to this embodiment of the invention, stream portions with alternatingly high and low concentrations of abrasive particles are created through controlled alternate deliberate passing of majorities of abrasive particles through two channels with a different flow resistance, such that the resulting velocity difference of two subsequently passed majorities in the two channels through the channels makes them meet downstream of the channel outlets. The two majorities combined then form a high concentration pulse of abrasive particles, within a high concentration stream portion. Subsequently passed remaining minorities of particles in the two channels that are not deliberately passed into the two channels combine downstream of the channel outlets into low concentration pulses within a low concentration stream portion. In this way, within the stream continuing downstream of the channel to the abrasive nozzles of the drill bit, high and low concentration stream portions alternate each other.

The generation of the pulses in the inventive method is based on the principle that, given that the pressure drop over the two channels is equal, the head start of the abrasive particles released into the first channel during the first time period with respect to the abrasive particles subsequently released into second channel during the second time period is after a certain length of the first and second channel compensated as a consequence of the larger velocity of the latter abrasive particles. Merging the two stream parts through the first and second channel again downstream of the channels into a single stream travelling at a single velocity, therefore merges abrasive particles subsequently released into the first and second channel in this single stream to flow together as a single pulse in a high concentration stream portion to the drill bit, and into the nozzles.

By employing this working principle, the current invention provides an alternative to the known systems, which employ other working principles.

Embodiments are envisaged wherein the deflection is controlled such that the stream flowing through the drill bit comprises stream portions with more than two levels of concentrations of abrasive particles. For example the first stream portion with a high concentration, the second stream portion with a low concentration, and a third stream portion with a concentration intermediate that of the first and second stream portion. For example repeatedly generating subsequently the first, third, second, and third stream portion, may result in the concentration of abrasive particles flowing through the drill bit more closely approaching a sine-wave. In an embodiment time periods of deflection into the first channel, no deflection into any channel, and deflection into the second channel are applied to produce the first, second and third stream portions.

Alternating the particle concentration in a flow of drilling fluid and abrasive particles, can be repeated multiple times, e.g. continuously during a directional drilling operation, to alternate the particle concentration in the flow that flows through the drill bit as it rotates.

As the invention provides the pulses of high concentration abrasive particles being created upstream of the drill bit—and thereby of the nozzles—it does advantageously not require significant modifications to drill bit or nozzles thereof, nor involves any blocking of nozzles. Furthermore, the dependency of the choice of drill bit for the driller on the method of directing the particles may be reduced, and overall drilling performance maintained at a higher level.

The pulses being created upstream of the drill bit—and thereby of the nozzles—furthermore enables the energy consuming parts for this purpose being located more remote from the borehole bottom than in currently known solutions, and to involve less moving—in particular, rotating—parts and parts facilitating this movement. This may reduce the overall vulnerability of the downhole system, and as such increase the robustness thereof.

According to the invention the drill bit may be a mechanical drill bit, e.g. a PDC drill bit or tricone drill bit. Therein the drill bit further comprises one or more wash nozzles on the bit face. Therein said rotating of said drill bit involves, next to the passing of the abrasive stream through the abrasive jet nozzles, mechanical cutting of the borehole bottom by said mechanical drill bit to deepen the borehole, in particular by means of mechanical cutters arranged on the bit face. The drill bit may also be an abrasive jet drill bit, devoid of any wash nozzles.

It is noted that the term 'deepening' includes extending of the borehole in all directions, that is, it also includes extending the borehole in a substantially horizontal direction.

The variation in abrasive particle concentration in the form of alternated highly and lowly concentrated portions within the drilling fluid may advantageously be created consistently along angular sectors of the borehole bottom impinged by the abrasive particles within the stream portions as the drill bit rotates. By attuning the timings at which these high concentration stream portions pass through the abrasive jet nozzles to the rotational speed of the bit—and therefore, to the rotational velocity of the abrasive jet nozzles, it is achieved that high concentration, stream portions impinge with a specific angular sector of the borehole bottom, that is, are passed through the abrasive jet nozzles when these are directed towards a specific angular sector of the borehole, and that the low concentration stream portions impinge with another angular sector of the borehole bottom, that is, are passed through the abrasive jet nozzles when these are directed towards the other angular sector. Said attuning means that the frequency is set to correspond to, or to be an integer fraction of, the number of rotations of the drill bit per time unit.

In embodiments of the method employing this principle, the first and second stream portions pass through the one or more abrasive jet nozzles at timings synchronized with a rotational velocity of the drill bit. The first stream portion pass said abrasive jet nozzles while the abrasive jet nozzles are directed towards a selected angular sector of the borehole bottom, and the second stream portion pass said abrasive jet nozzles while the one or more abrasive jet nozzles are not directed towards a selected angular sector of the borehole bottom.

The invention furthermore provides a directional drilling system for implementing a method according to the invention.

In an embodiment of such a directional drilling system for directional drilling of a borehole with a borehole bottom in an object, e.g. an earth formation, e.g. a subterranean earth formation, connectable to a tubular drill string, the directional drilling system comprises a drill bit and a sub.

The drill bit, comprises:

- a bit face, which during use faces the borehole bottom,
- a bit fluid inlet port,
- one or more abrasive jet nozzles configured for ejecting a stream of drilling fluid mixed with abrasive particles into impingement with the borehole bottom in the form of an abrasive jet, which one or more abrasive jet nozzles, if in plural, are arranged at different azimuthal positions, and
- an intermediate space between the bit fluid inlet port and said one or more abrasive jet nozzles, each of the one or more abrasive jet nozzles having a nozzle inlet for fluid communication with the intermediate space, from which each of the nozzle inlets extends.

The sub is connected or connectable at a downhole end thereof to the drill bit, e.g. so as to be rotatable along therewith, and at another end thereof to the tubular drill string. The sub comprises:

- a sub fluid inlet port, fluidly connectable to a supply channel through the drill string to receive from said supply channel a stream of drilling fluid mixed with abrasive particles when the system is connected to the drill string, and
- a sub fluid outlet port, fluidly connected or connectable to the bit fluid inlet port.

According to the invention, the sub further comprises, fluidly connected to the sub bit inlet port, downstream thereof, a modulation unit configured to cause a variation of a concentration of abrasive particles along stream portions of the stream received from the supply channel that are subsequently passed through the sub bit fluid outlet port into the bit fluid inlet port.

The modulation unit comprises:

- a first channel having a first flow resistance to the drilling fluid mixed with abrasive particles, a first inlet, and a first outlet fluidly connected to the sub bit fluid outlet port,
- a second channel arranged in parallel to the first channel, having a second flow resistance to the drilling fluid mixed with abrasive particles, a second inlet, and a second outlet fluidly connected to the sub bit fluid outlet port,
- a particle deflection device between the sub bit fluid inlet port and the first and second inlets, comprising one or more actuators, and being connected to a control unit of the system, The particle deflection device is configured to periodically, preferably based on control signals received from the control unit,

- during a first time period, deflect into the first inlet a majority of all abrasive particles received from the supply channel through the sub bit fluid inlet port, and
- during a second time period following the first time period, not deflect into the first inlet a majority of all abrasive particles in the stream received from the supply channel through the sub bit fluid inlet port.

The first and second channel are embodied such that a difference between the first flow resistance and the second flow resistance results in a velocity difference between said drilling fluid mixed with abrasive particles passing through said first channel and said drilling fluid mixed with abrasive particles passing through said second channel.

The velocity difference is such that in a combination section downstream of the first and second outlets, the majority deflected into the first channel during the first time period and the abrasive particles passed into the second channel during the second time period, together with any of said drilling fluid passed into the first and second channel during the first and second time period, respectively, are combined into one of said stream portions, and abrasive particles passed into the first channel during the second time period and the abrasive particles passed into the second channel during a first time period following the second time period, together with any drilling fluid passed into the first channel during the second time period and into the second channel during the first time period following the second time period, respectively, into a subsequent one of said stream portions.

Thus, according to the invention, stream portions with alternatingly high and low concentrations of abrasive particles are created by passing drilling fluid comprising abrasive particles through two channels that have different flow resistances, and by a controlled periodical passing of a majority of abrasive particles through one of said two channels, preferably by controlled passing of a majority of abrasive particles alternatingly through a first and a second channel.

In a preferred system, during the second time period, particles are deflected into the second sub channel, thus increasing the particle concentration in the second sub flow while reducing the particle concentration in the first sub flow. In such a system, the control unit and the deflector are configured to during a first time period, deflecting into the first channel a first majority of all abrasive particles in the stream that pass through the supply channel outlet, and into the second channel a second majority of all abrasive particles in the stream that pass through said supply channel outlet, and subsequently passing said stream from the first and second outlets into said one or more abrasive jet nozzles.

Therein the velocity difference is such that in a combination section downstream of the first and second outlets, the majority deflected into the first channel during the first time period and the abrasive particles passed into the second channel during the second time period, together with any of said drilling fluid passed into the first and second channel during the first and second time period, respectively, are combined into one of said stream portions, and abrasive particles passed into the first channel during the second time period and the abrasive particles passed into the second channel during a first time period following the second time period, together with any drilling fluid passed into the first channel during the second time period and into the second channel during the first time period following the second time period, respectively, into a subsequent one of said stream portions.

Thus, according to the invention, stream portions with alternatingly high and low concentrations of abrasive particles are created through controlled alternate deliberate passing of majorities of abrasive particles through two channels with a different flow resistance, such that the resulting velocity difference of two subsequently passed majorities in the two channels through the channels makes them meet downstream of the channel outlets. The two majorities combined then form a high concentration pulse of abrasive particles, within a high concentration stream portion. Subsequently passed remaining minorities of particles in the two channels that are not deliberately passed into the two channels combine downstream of the channel outlets into low concentration pulses within a low concentration stream portion. In this way, within the stream continuing downstream of the channel to the abrasive nozzles of the drill bit, high and low concentration stream portions alternate each other.

In embodiments of the system, attuning of the timings at which these high concentration stream portions pass through the abrasive jet nozzles to the rotational speed of the bit—and therefore, to the rotational velocity of the abrasive jet nozzles is achieved by the configuration of the control unit. The control unit is configured such that the signals thereof received by the deflection device cause the time periods in which the actuators of the deflection device deflect said first and second majority of particles into the first and second channel to be synchronized with the rotational velocity of the drill bit such, that said one of said stream portions passes through the one or more abrasive jet nozzles while the abrasive jet nozzles are directed towards a selected angular sector of the borehole bottom, together with any of said drilling fluid passed into the first and second channels during the first and second time periods, respectively, and said subsequent one of said stream portions passes through the one or more abrasive jet nozzles while the abrasive jet nozzles are not directed towards said selected angular sector of the borehole bottom.

By modulating the concentration variation of abrasive particles, as described before in relation to the prior art, the erosive power of the high and low stream portions is modulated. Accordingly, in the described embodiments, the erosive power of the stream is relatively high in the selected angular sector, and low outside of the selected angular sector of the borehole bottom. The borehole is therefore deepened at a faster rate in the selected angular sector than outside thereof, causing the drilling direction to be deviated away from the selected angular sector.

The varying of the concentration along subsequent stream portions may be done continuously over a certain number of rotations of the drill bit, so that first and second stream portions are alternatingly produced and ejected through the abrasive jet nozzles, and the variation takes place during each rotation—when the frequency of the produced stream portions is equal to the frequency of the drill bit rotations—or during one of a multiplicity of rotations, e.g. during each second, third, fourth, and so on, rotation—when said frequency of the produced stream portions is equal to an integer fraction of the frequency of the drill bit rotations. A lower frequency of the ejection of high concentration stream portions leads to a lower differential hole making—that is, the drilling velocity difference between the inner and outer bend of the curved borehole section being drilled—and vice versa. The frequency may thus be adjusted to modulate the differential hole making.

As an example, as desired for a pure abrasive jet drilling system with one nozzle, the concentration of abrasive particles in the stream arriving at the drill bit can be a constant (i.e. 100% of the supplied abrasives concentration) with a sinusoidal variation with time on top of it. If the required directional action is expected to be achieved by a 4% differential hole making, i.e. the rock removal rate on one side of the bore hole is to be 4% faster than on the opposite side of the hole the steering sub would be tuned to produce a constant 100% abrasives concentration with a sinusoidal oscillation with a 2% amplitude superimposed on it. Alternatively a 4% amplitude could be used for every second bit rotation, or an 8% amplitude for every fourth bit rotation, etc.

It is also envisaged that in order to modulate the differential hole making, for example a first, high concentration stream portion and a second, low concentration stream portion may be ejected every rotation of the drill bit for a number of rotations, and then said variation along the ejected stream portions is stopped for a number of rotations. Performing the deflection during a number of rotations only may furthermore be used to correct or fine-tune a steering action.

The differential hole making may furthermore be adjusted by adjusting the concentration of the abrasive particles in the stream upstream of the deflection of the majorities thereof. For instance, in the case of mechanical drilling, wherein the constant hole making action may come from the mechanical rock cutting and all the steering action may come from the concentration variation of the abrasive particles within the abrasive jet, reducing the steering action by for instance a factor 4 may be done e.g. by reducing the supplied abrasives concentration by a factor 4, or e.g. by reducing the amplitude of the abrasives concentration fluctuation by a factor 4. In the case the control unit, e.g. a downhole control unit, obtains direct feedback on the abrasives concentration with time, including the concentration difference, the control unit may automatically respond to any changes in the concentration of abrasives of the stream supplied from the supply channel.

The fraction of abrasive particles passing through the supply channel outlet that is deflected into the first and second channel during the first and second time period, respectively, determines the concentration difference of the abrasive particles between the first and second stream portion. Therewith, it determines the difference in the erosive power of the abrasive jet in said selected first and second angular sectors of the borehole bottom, and thus, the differential hole making. At least a majority of the particles should be deflected into the first channel during the first time period to achieve a concentration difference. Preferably, a majority of the particles is deflected into the first and second channel during the first and second time period, respectively, to achieve a concentration difference.

If a first and second majority of the particles are deflected into the first and second channel during the first and second time period, respectively, than the first and second majority consists of at least 50%, and at most 100% of the abrasive particles within the stream received from the supply channel during the first and second time period, respectively, in order to achieve a concentration variation between the subsequent stream portions downstream of the first and second outlets. This means that the concentration of abrasive particles in the high concentration stream portions, that is, the first stream portions, is higher than 100% and at most 200% of the concentration thereof upstream of the deflection of any abrasives, and lower than 100% thereof in the low concentration stream portions, that is, the second stream portions.

In the case of pure abrasive jet drilling, e.g. using a dedicated abrasive jet drill bit, the concentration difference of the abrasive particles between the first and second stream portion is preferably much less than 200% of the concentration of abrasive particles upstream of the deflection, in order to achieve continued forward drilling—because the deepening of the borehole is established only through the erosive power of the abrasive jet. This means that the concentration should in the first, high concentration stream portion be less than 200% of the concentration in the stream prior to deflection, and more than 0% thereof in the second, low concentration stream portion. After all, the second stream portion should still have some erosive power to establish an inner bend of the borehole.

In particular, in case of pure abrasive jet drilling, the steering action may be achieved by a difference in concentrations between the first and second stream portion of lower than 50% of the concentration of abrasive particles upstream of the deflection, e.g. 0% to 40% to achieve an advantageous ratio of drilling velocities between the inner and outer bend. In an example steering action, the concentration difference is in the order of a few percent, e.g. 2-10%. In the case of a concentration difference of 8% for instance, this means that the concentrations of the first and second stream portion are 104% and 96%, respectively, and the majorities consist of 52% of the abrasive particles within the stream received from the supply channel.

For example, in another, large steering action for a bent trajectory of a 10 cm diameter borehole along a radius of more than 10 m, utilizing pure abrasive jet drilling, a concentration variation of abrasive particles between the first and second stream portions of 4% is amply sufficient. Short radius side tracking, which forms an application for abrasive jet drilling, may require build sections with trajectories with a bending radius shorter than 10 m and the operator may prefer a concentration variation of around 10% between the first and second stream portions.

In the case of combined mechanical and abrasive jet drilling, e.g. using a PDC or tricone drill bit with one or more abrasive jet nozzles, said concentration difference may be up to 200%—its value depends on the relative contributions to the drilling velocity of the abrasive jet and the cutters. Generally, the abrasive jet is in this case meant only for creating the steering effect and the value is preferably as close as possible to 200%, which translates in a deflection of as close as possible to 100% of the abrasive received from the supply channel. In particular, between 70% and 100% of the abrasive particles is deflected into the channels, resulting in a concentration difference between the first and second stream portions of between 80% and 200%. In a practical embodiment around 80% of the abrasive particles is deflected, so that the concentrations of the first and second stream portion are 160% and 40% of the stream as received from the supply channel, respectively, and the concentration difference is 120%.

The differential hole making is in the order of the ratio between the radius of the hole and the bending radius of the curved borehole section. As an illustration, a differential hole making of 0.5-2% is sufficient in the case of a bending radius of 5 meters and a radius of the bit of 5 centimetres.

When after directional drilling of a curved borehole section, a straight borehole section is to be drilled, said deflection of the majorities into the channels may be stopped completely while continuing the passing of the stream and the rotation of the drill bit, so that the concentration of abrasive particles is substantially constant along each rotation of the drill bit. When operating a system according to the invention, the modulation device may be switched off to achieve this—e.g. by stopping a power supply thereto. When using a mechanical drill bit, the supply of abrasive particles may also be stopped completely in drilling straight borehole sections, however, it is preferred that the supply thereof continues, e.g. at a relatively low concentration, while stopping the deflection.

In an embodiment, said deflection of the abrasive particles into the first and second channel is established by mechanical means, e.g. mechanical barriers.

In particular, the deflection may be established by straining. Therein, one or more movable strainers may be provided upstream of the first and second inlet, which are adapted to pass any drilling fluid within the stream, while reducing or preventing the passing of abrasive particles into the first and second channel during the first and second time period, respectively, thereto alternately being moved along the cross-section of the outlet of the supply channel such as to cover the first and second channel, respectively. Said moving may e.g. be in the form of pivoting or sliding.

In another example, a movable chute- or funnel-shaped element may be arranged directly upstream of the first and second inlets, which covers a part of the cross-section of the stream, and is adapted to deflect at least a majority of the abrasive particles passing towards the first and second channel by directing the flow of abrasive particles along a guiding surface thereof while bypassing drilling fluid there behind, the guiding surface alternately being moved, e.g. slid or pivoted, towards the first and second channel during the first and second time periods, respectively.

In an embodiment employing mechanical deflection means, the first and/or second inlet are/is radially movable relative to the supply channel outlet, for example, the first and/or second channel are movable as a whole relative to the supply channel outlet. In these examples the particle deflection device can be passive, i.e. move the particles continuously in a particular direction, while the first and/or second inlet are/is actively supported, i.e. the first and/or second channel are at the inlet end movable supported, and the inlet of the first and/or second channel are/is moved into and out of the flow of particles deflected by the particle deflection device.

In an embodiment, the first and/or second channel are movable supported at their inlet end, and the particle deflection device comprises a particle concentrating device, which is arranged directly upstream of at least the first inlet, and between the supply channel outlet and the channel inlet(s). This concentrating device deflects the particles received from the supply channel such that the abrasive particles are supplied in a higher concentration in a first cross-sectional portion of an outlet thereof than in a second cross-sectional portion of this outlet. The concentrating device may utilise a sieve or strainer, and/or a magnetic field for deflecting the particles towards the second cross-sectional portion of the outlet.

A radial relative moving of at least the first, optionally also the second, inlet relative to the first and second cross sectional portion of the concentrating device results in decreasing or increasing the cross-sectional portion of the respective inlet that is within the contours of the first and second portion of the outlet of the concentrating device, so that the respective inlet receives a higher or lower concentration of particles. In an example the relative radial movement is achieved by radially moving at least the first inlet with respect to the first and second portion of the outlet of the concentrating device. In another example the radial movement is achieved by radially moving the concentrating device with respect to at least the first inlet, in addition or alternative to the radial moving of the channel inlet(s).

In an embodiment the relative radial movement is actively driven by an actuator mechanism of the deflection device.

The concentrating device comprises an inlet fluidly connected to the supply channel outlet for receiving the stream of drilling fluid mixed with abrasive particles from the supply channel, and the mentioned outlet. The concentrating device is configured to deflect a majority of the abrasive particles of the supply stream into the first portion of the outlet, and a minority of the abrasive particles into the second portion of the outlet, so that the concentration, and thus the flow rate, of abrasive particles is high in the first portion of the outlet and low in the second portion of the outlet. For example, such concentrating device is a strainer. In effect, the concentrating device may form an extension of the supply channel.

In an embodiment the first channel is movable such that its inlet is in a first position in which it is radially at least partly within the contour of, e.g. is axially in line with, the first portion of the outlet of the concentrating device during the first time period, so that the first inlet receives the abrasive particles of the supply stream at the high concentration. The first channel is furthermore movable such that during the second time period, its inlet is in a second position in which it is at least partially radially outside the contour of, e.g. is axially not in line with, the first portion of the outlet of the concentrating device during the second time period, so that the first inlet does not receive, or receives less of, the abrasive particles of the supply stream at the high concentration—and thus, flow rate, so as to receive the abrasive particles at a lower concentration. For example the first inlet is in the second position during the second time period at least partially inside the contour of the second portion of the cross-section of the outlet of the concentrating device, so as to receive the abrasive particles of the supply stream at a lower concentration.

In an embodiment, the first channel, or at least an inlet end thereof, is pivotable about a radially extending axis remote from the inlet to move the first inlet between the first and second position. In an embodiment, the first channel is translatable in the radial direction to move the first inlet between the first and second position.

In embodiments, the second channel is movable similarly as described for the first channel, such as to receive the particles at the low concentration in the first time period and at the high concentration during the second time period.

In an example, the second channel is movable simultaneously with, e.g. along with, the first channel such that in the second position of the first inlet, the second inlet is radially at least partly within the contour of, e.g. axially in line with, the first portion of the cross-section of the outlet of the concentrating device during the second time period. The effect is that the first and second channel alternatingly—during the first and second time period—receive the abrasive particles of the supply stream at a high concentration.

In an alternative embodiment, the supply channel, e.g. a downstream part thereof, e.g. the outlet thereof, e.g. provided with the concentrator, is movable relative to the first and second channel for alternatingly directing the high and low concentration of particles into the first and second channel. In an example the concentrating device is movable for this purpose.

In an embodiment, the first and second portion of the outlet of the concentrating device are adjacent portions of the cross-section—one portion not enclosing the other. In another embodiment, the first portion of the concentrating device outlet is radially enclosed by the second portion of the concentrating device outlet, e.g. the first and second portion being concentric.

In an embodiment wherein the first portion of the concentrating device outlet is radially concentrically enclosed by the second portion of the concentrating device outlet, the first channel is, correspondingly, arranged inside the second channel so that the inlet of the first channel is radially enclosed by the second channel, and is concentric with the second channel in the first position of the first channel. Thus, in the first position of the first channel, the first channel is axially in line with the first portion of the outlet of the concentrating device. Therein the actuator mechanism of the deflection device is preferably arranged in the second channel, and is configured to move the first channel between the first and second position of its inlet, for example, configured to pivot the first channel around a radially extending pivot axis axially remote from its inlet, e.g. near the outlet of the first channel. Thus, in the second position of the inlet of the first channel, the first channel is eccentrically arranged within the second channel and out of axial alignment with the first portion. At least a smaller part of its inlet is within the contour of the first portion, preferably no part at all, and at least a larger portion of its inlet is within the contour of the second cross-sectional portion of the concentrating device outlet, so as to receive the abrasive particles of the stream at a lower concentration. At the same time, the first channel being eccentrically arranged within the second channel in the second position of the first inlet, makes that at least a smaller part of the second inlet is within the contour of the second portion and at least a larger part within the contour of the first portion—preferably the contour of the first portion is completely radially covered by the second inlet in the second position of the first inlet. In this embodiment by moving only the first channel, both the first and second inlet are moved between the first and second position thereof.

Another embodiment is envisaged wherein the particle concentration device, e.g. not the first and second channel, is movable such that the first and second portion of the outlet are radially moved relative to the first and second inlet into a first position thereof in which the first inlet is at least partly radially within the contour of the first portion during the first time period, and into a second position thereof in which the first inlet is at least partially radially outside the contour of the first portion during the second time period, so as to receive the abrasive particles of the supply stream at respectively a high and low concentration.

In an embodiment, the actuator mechanism of the deflection device, in this case configured for moving the first channel inside the second channel, is arranged inside the second channel. In an example actuator mechanism comprises a motor, e.g. a linear motor, which is controllable by a control unit, e.g. as discussed herein, which is directly or indirectly connected to both the first and second channel, so as to drive the movement of the first channel inside the second channel. The actuator mechanism may comprise a transfer mechanism to convert the output movement of the motor to the relative movement of the first channel.

For example, the transfer mechanism comprises a cable and a cable guide fixed to either the first or second channel, the cable running from the motor to the first channel via the cable guide. For example the motor is a linear motor of which the linear output movement is in the axial direction, and the cable guide guides the cable to engage the first channel in a radial direction, so that the operation of the linear motor makes the cable pull the first channel in a radial direction. The transfer mechanism further comprises an elastic element, e.g. a spring, acting between the first and second channel at a location diametrically opposite the radial location at which the cable engages the first channel, or at the same radial location and at some axial distance, and counteracting a pulling action of the cable. Therein the first channel is preferably pivotable around a radially extending pivot axis axially remote from its inlet, for example near or at its outlet, the cable of the actuator mechanism engaging on the first channel at or near the first inlet. Alternatively, the first channel may be translatable in the radial direction.

In another example, the transfer mechanism comprises a channel wall guide coupled to the motor and an elastic element, e.g. a spring. In this case the channel wall guide cooperates with the outer wall of the first channel for converting the output movement of the motor to the relative movement of the first channel. The wall guide and the first channel wall engage at complementary slanted surfaces in the axial-radial direction, so that an axial movement of the motor makes the slanted surfaces slide over one another, thereby inducing a radial movement of the first channel. The elastic element interconnects the first and second channel at the same, or at a radial location diametrically opposite, the radial location at which the cable engages the first channel to counteract the pulling action of the cable.

The current invention furthermore relates to the mechanical actuator mechanism according to any of the embodiments described above for use in the directional drilling system, and the particle deflection device comprising this mechanical actuator system.

In an embodiment, the deflection of the particles into the first and second channel is established by magnetic means, instead of or in addition to mechanical means.

As is known from the art, in embodiments the abrasive particles may be magnetic abrasive particles, e.g. a steel shot. In this case the deflection of the abrasive particles into the first and second channel may be established by changing, e.g. reversing, a direction of a magnetic field over a cross-section of the stream directly upstream of the first and second channel between a direction in the plane of said cross-section towards the first channel and a direction in the plane of said cross-section towards the second channel, respectively.

In an embodiment of the system according to the invention, this magnetic field is produced by a capturing means as disclosed in US2012/0255792, being placed directly upstream of the first and second inlet.

In another, preferred embodiment of the system according to the invention, the deflection into the first and second channel is achieved by alternatingly directing in the first and second time period a magnetic field over the cross-section of the stream directly upstream of the first and second inlet towards the first channel and towards a second channel.

The amount of energy required for creating the concentration difference between the subsequent stream portions largely depends on the manner of deflection of the abrasive particles. Deflecting the particles by said switching of the magnetic field over the cross-section is advantageously less energy consuming than employing said capturing means, or employing mechanical deflection.

As induced by the magnetic field over the cross-section, the magnetic abrasive particles are magnetised in adaptation to the magnetic field. The induced N-poles of the particles tend to move towards the S-pole of a magnet creating the field, and vice versa. When the field is inhomogeneous, the particles tend to move towards a part of the magnetic field with a higher density of field lines. Employing this principle, the particles are directable towards a respective one of the first and second channel by establishing a magnetic field over the cross-section of the stream that is more dense in a part thereof covering the respective channel than the other channel.

In an embodiment of the method, the changing of the magnetic field is therefore done such that the density of the magnetic field is higher in a part of the cross-section of the stream covering the first channel than in a part covering the second channel during the first time period, and higher in the part of the cross-section covering the second channel than in the part covering the first channel during the second time period.

Embodiments of the system according to the invention provide for this purpose that the actuators of the deflection device comprise a magnetic switch, which is configured to during the first period produce an inhomogeneous magnetic field over a cross-section directly upstream of the first and second inlets that in the plane of said cross-section directs the abrasive particles towards the first inlet and to during the second period produce an inhomogeneous magnetic field over a cross-section directly upstream of the first and second inlets that in the plane of said cross-section directs the abrasive particles towards the second inlet. Therein the magnetic field produced in the first time period is inhomogeneous in that the density thereof is higher in a part of the cross-section covering the first channel than in a part covering the second channel. The density of the magnetic field produced in the second time period is higher in the part of the cross-section covering the second channel than in the part covering the first channel.

In embodiments the magnetic switch thereto comprises multiple magnets arranged at different azimuthal positions along an outer circumference of the stream directly upstream of the first and second inlets, e.g. along a circumference of a channel accommodating said stream at that location, which together produce the inhomogeneous magnetic fields.

In one embodiment the multiple magnets are permanent magnets, and the actuators further comprise drive means connected to the magnets. The drive means are configured to move the magnets as a unity along the circumference upon a switch between the respective time periods to establish that the magnetic fields direct the abrasive particles towards the respective channels during the respective time periods.

In other embodiment the multiple magnets arranged along the circumference are electromagnets. Therein the difference between the directions of the magnetic fields in the first and second time periods may be achieved by reversing currents therethrough, and/or individual movabilities thereof, e.g. rotatabilities thereof around axes perpendicular to the cross section, or common movability thereof along the circumference, and/or by running currents through different selected ones of the multiple magnets. Said current reversion and/or selective running of currents may be established by an electrical conduit based on the signals of the control unit and said movability by mechanical drive means.

In embodiments of the invention the difference between the flow resistance to said drilling fluid mixed with abrasive particles in said first channel and said second channel is established by a difference between said first and second channel in respective lengths thereof in the longitudinal direction, in respective cross sections thereof, in respective surface roughness of inner wall surfaces thereof, and/or in variations of the respective cross sections and/or surface roughness of inner wall surfaces thereof along said respective lengths thereof, e.g. in the form of surface profiles, obstacles, indentations and/or protrusions, and/or in variations of the shape of the channel(s), e.g. along the length, e.g. in the form of curvatures or bends. These resistances may in embodiments be adjusted along the process, e.g. by adding, adjusting or removing surface roughnesses, obstacles, or e.g. by adding, adjusting or removing bends or curvatures of the channel(s).

The flow resistances felt in total by the drilling fluid mixed with abrasive particles during passing from the first and second inlet to the first and second outlet, respectively, must be attuned to each other to achieve that the majorities of abrasive particles are combined downstream of the outlet.

In a particular embodiment, said difference between the flow resistance to said drilling fluid mixed with abrasive particles in said first channel and said second channel is established by a difference between said first and second channel in respective cross sections thereof, said respective lengths and surface roughness of inner wall surfaces and said variations therein along said respective lengths being equal to each other.

In embodiments the lengths of the first and second channel are equal to each other. In embodiments the first and second inlets and first and second outlets are arranged in the same cross-sectional plane along the stream—that is, the first and second channels start and end at the same location along the drill string. In embodiments the flow resistance of the first and/or second channel to the drilling fluid mixed with abrasive particles is constant along the length. In embodiments the first and/or second channel is completely straight over the length. In embodiments the cross-section of the first and/or second channel is constant along the length. In embodiments the first and/or second channel comprise local reductions in the cross-sectional area along the length. In embodiments the first and second time periods are equal to each other.

In embodiments the first and second channel together have a circular cross-section and are straight in the flow direction of the stream, such as to together form a cylinder. The channels are separated from each other only by a straight wall within the cylinder. In one of these embodiments the cross-sections and surface roughness of the channels are constant along the length thereof, the lengths are equal to each other, and the flow resistance is substantially determined by the difference in cross-sectional area, which is achieved by having the wall extend offset from a central axis of the cylinder.

In an embodiment, the first channel is arranged inside the second channel. Preferably, the first channel is arranged concentric with the second channel. In another embodiment, the second channel is arranged inside the first channel, e.g. concentrically.

In an embodiment, the system is configured to move the abrasive particles in the flow towards the wall of the channel through which the flow is passed. By bringing the particles near the wall of the channel, the particles can better be manipulated by magnets located outside the channel. In an embodiment, the system is configured to provide a swirl in the flow to thus move the abrasive particles in the flow to the outside of the flow, i.e. adjacent to the wall of the channel through which the flow is passed. For example, the channel through which the flow is passed may be provided with vanes that generate a swirl in the flow. The centrifugal force generated by the swirl moves the abrasive particles to the perimeter of the flow, and thus close to the channel wall where the magnetic field of a magnetic deflector is the strongest and the deflection the easiest to establish.

In a preferred embodiment, the blades are configured to generate a swirl that makes a full rotation within the length of a magnetic separator located along the channel through which the flow is passed.

In an embodiment, substantially axial grooves or gutters are provided on the inside surface of the wall of the channel, the grooves or gutters preferably extending along the length of the deflection section, i.e. the section in which the particles are deflected into the first or second channel, to guide the particles to the entrances of the channels.

Preferably, the swirl is removed from the flow, once the abrasive particles have been moved through the periphery of the flow. Therefore, in an embodiment, downstream of the vanes generating the swirl, other vanes may be provided that are shaped to temper the swirl of the flow, preferably remove the rotational movement of the drilling fluid and abrasive particles carried by the drilling fluid. Thus, the flow is made substantially axially, prior to entering the channels.

In embodiments the length of the first and second channel is between 2 and 3 meters. For operational convenience it is desirable to have an assembly including drill bit, directional and other sensors used by the modulation device with the first and second channel, e.g. within a steering sub, eventually formation evaluation sensors, optionally a recirculation unit, e.g. within a recirculation sub, stabilizer sub(s), and eventually a pulser or electro-magnetic telemetry sub within a length of 9.5 meter. The section of the first and second channel does not have to be stiff, as long as any directional sensors are placed downstream inside a stiff section connected to the drill bit.

In embodiments the (effective, e.g. in case of non-circular channels) diameter along the length is larger than five times that of the abrasive particles to avoid blockage of the channel, e.g. at least 0.2 cm2 in case of 1 mm diameter abrasive particles. In practical embodiments the maximum cross sectional area of the second channel is limited by the internal cross section of a typical drill string, e.g. oil drill string, component, usually maximum 0.6 times the hole diameter, the cross-sectional area thereof required for the first channel and the cross-sectional area taken up by any walls between the channels, possibly some part of the cross-sectional area for e.g. wiring between sensors, a control unit, (parts of) the deflection device and/or any additional intermediate space. The sum of the cross-sectional areas of the two channels is preferably as large as possible, in order to not restrict the flow more than necessary and create unnecessary pressure loss and wear. For example, in a 10 cm borehole, the internal diameter could be around 6 cm, the room for the channels being around 30 cm2.

In embodiments the pressure drop over the length is typically less than 50 kPa. In embodiments a ratio of the flow rates within the first and second channel is typically in between 1 and 10, and a ratio of the velocities is typically in between 1.2 and 3. In embodiments the first and second time periods are both between 0 and 1.5 second. For example, the first and second time periods may be 0.5 seconds to be synchronized with the rotational velocity of the drill bit of 60 rotations per minute.

In an example embodiment for an assembly drilling a 10.5 cm diameter bore hole the first and second channel have equal locations of the inlets and outlets along the drill string, a constant flow resistance along the length, and the lengths of the first and second channel are both equal to 2 meters. Therein the cross-section of the first channel is around 7 cm2, and that of the second channel around 23 cm2. The pressure drop over the channel lengths is around 5 kPa, with a flow rate of the entry stream of around 0.50 m3/min, with a ratio of the flow rates within the first and second channel of around 5, respective velocities of around 1.8 and 3.0 m/s and first and second time periods of around 0.5 seconds. The rotational velocity of the drill bit is around 60 rotations per minute, so that every half rotation a first or second majority is passed into the first or second channel, respectively, and the headstart of a first majority deflected into the second channel is around 0.5 seconds. This head start is made up by a second majority subsequently deflected into the first channel 0.5 seconds later, both of said majorities passing out of the first and second outlet around 1.15 seconds after the first majority passed through the first inlet.

Typically the abrasive particles have a diameter of around 0.6-1.0 mm. A concentration of about 0.2 vol % of abrasive particles is typically sufficient for a normal steering action depending on bit pressure drop and the rock removal balance by the drill bit.

In envisaged embodiments, the first and/or second flow resistance of the first and second channel are adjustable during rotation of the drill bit by adjusting, e.g. based on signals of the control unit, one or more of the mentioned quantities determining the flow resistances. For example by adjusting or adding a local reduction in cross-section within one or both of the channels, e.g. moving an obstacle into the channel, or by adjusting the length(s), e.g. telescopically. Said adjustability may facilitate anticipation to changing conditions within the borehole while progressing further into the object.

In the case that the drill bit is a mechanical drill bit, preferably the drilling fluid passed through the wash nozzles originates from the stream passed through the channels. In order to at the same time pass the abrasive particles from the same stream through the abrasive jet nozzles along with drilling fluid from the stream, the abrasive particles are strained at the side of the abrasive jet nozzles.

In embodiments of the method according to the invention the method thereto further comprises, simultaneously with said impingement of the borehole bottom by said stream,

- straining the abrasive particles in said first and second stream portions upstream of said abrasive jet nozzles and said wash nozzles, e.g. in the intermediate space of the drill bit, and
- deflecting the strained abrasive particles into the abrasive jet nozzle(s), while
- passing of the drilling fluid in said first and second stream portions of the stream into both the abrasive jet nozzles and the wash nozzles.

In embodiments of the system according to the invention the drill bit further comprises for this same purpose a strainer, arranged inside the drill bit within the intermediate space thereof, and rotating along with the drill bit. The strainer is configured to direct the abrasive particles in said stream as received through the bit fluid inlet port into the abrasive nozzles, while passing drilling fluid within said stream into both the abrasive jet nozzles and the wash nozzles.

In alternative embodiments the drill bit comprises for this same purpose a deflector, e.g. a magnetic deflector or a chute directed towards the abrasive jet nozzles, configured to guide the abrasive particles towards the abrasive jet nozzles. Abrasive particles mixed with the drilling fluid have a higher density and therefore a higher inertia than drilling fluid without abrasive particles. As a result, the abrasive particles have a longer memory of the flow direction at which they were released into fluid, and therefore the concentration in that direction and in the first area is relatively increased during any distribution of drilling fluid over both the wash nozzles and abrasive jet nozzles.

In the case that the drill bit is a mechanical drill bit, devoid of any wash nozzles, the stream is generally passed into the abrasive jet nozzles in its entirety. In embodiments the one or more abrasive jet nozzles consist of one single abrasive jet nozzle only.

In embodiments, the drill bit rotates relative to the drill string part, the latter being held stationary with respect to a longitudinal rotation axis of the drill bit and slid along with the drill bit further into the borehole as it deepens.

In embodiments, the drill bit rotates along with the drill string, the drill bit being fixed thereto via the sub. In other embodiments it rotates relative to the drill string, the latter rotating at a different rotational velocity, e.g. at a higher velocity to mitigate stick-slip vibrations. For this relative rotation a motor, e.g. a mud motor, is provided between the sub bit and the drill bit, which is commonly known in the art.

For a pure AJD bit, a high rotational velocity does not improve the rate of penetration and increases wear of the bit. The preferred rotational velocity of the bit for the purpose of steering is between 40 and 150 rotations per minute. The rotational velocity should not be so low as to excite stick-slip vibrations.

Preferably, the channels rotate along with the sub—in view of the robustness of the system, which as noted before among others depends on the number of downhole rotating parts relative to the drill string. In embodiments of the system the first and second channel are thereto fixedly mounted inside the sub, e.g. the modulation device comprising these channels is fixedly mounted inside the sub, so as to be rotated along with the sub, e.g. along with the drill bit.

In embodiments of the method according to the invention, the method comprises a downhole recirculation of abrasive particles passed through the abrasive jet nozzles into impingement with the borehole bottom. This downhole recirculation comprises:

- capturing at least a part of the abrasive particles present in the stream downstream of said impingement thereof with the borehole bottom, e.g. at a substantially constant flow rate, and
- passing the captured abrasive particles into said stream upstream of said abrasive jet nozzles, e.g. upstream of said drill bit, e.g. upstream of said first and second channel.

Therein said abrasive particles may be magnetic abrasive particles, e.g. a steel shot, and said passing of said abrasive particles into said stream includes the employment of a magnetic field to convey said abrasive particles to the stream.

In embodiments of the system according to the invention, the system thereto further comprises a recirculation unit suitable for recirculation of the magnetic abrasive particles passed through the abrasive jet nozzles into impingement with the borehole bottom. This downhole recirculation unit comprises one or more magnets, e.g. one or more movable magnets, arranged such that one or more magnetic fields thereof attract abrasive particles downstream of said impingement thereof with the borehole bottom, and convey the attracted particles at a substantially constant flow rate to a mixing chamber through which said stream passes upstream of said abrasive jet nozzles. Examples of such recirculation units are disclosed in the earlier discussed WO2008/119821, WO2005/005767 and WO2005/05766.

The passing of the captured abrasive particles into the stream towards the abrasive jet nozzles advantageously takes place downstream of the first and second channel when employing an abrasive jet drill bit, not passing the modulation device.

In a practical example, the abrasive particles typically recirculate 5 to 10 times at the drill bit, within a fraction of a second, well within a full rotation of the bit. The abrasives recirculation can in this case be considered as a concentration amplifier at the abrasive jet bit downstream of the dual channel section of the steering sub. The recirculation will make the transitions along the stream from first to second stream portions and back less abrupt, but, if considered that the recirculated particles extend the first, high concentration stream portion in terms of the time period in which the first stream portion passes through the abrasive jet nozzle(s), this extension of the time periods is typically not more than 0.1 second and the impact on the steering is minimal as long as the rotational velocity of the drill bit does not exceed around 150 rotations per minute, with a synchronized frequency of the stream portions with this rotational velocity.

The addition of the captured particles does reduce the difference between the concentrations along the subsequent stream portions, so that the majorities deflected into the channels must form a larger portion of the total of the abrasive particles passed into the channels to achieve the same concentration difference, and thus, the same difference in erosive power along the borehole bottom. The recirculation may be used to fine-tune the differential hole making—and therefore the steering action.

In these recirculation units, the abrasive particles are typically recirculated very fast relative to the first and second time periods—namely on a time scale of around 0.01 sec, and then escape after on average round 8 recirculations. After escaping, the abrasive particles travel through the annulus of the drill string back to the surface.

When employing a mechanical drill bit in combination with recirculation, the captured abrasive particles are preferably passed into the stream upstream of the first and second channel, in view of the high concentration difference to be achieved along subsequent stream portions, preferably as close as possible to 200%, in which case said deflected majorities must be 100% of the received abrasive particles from the supply channel.

Concentrations of abrasive particles supplied from surface range typically from 0.1% for mechanical drilling, without down hole recirculation to 1% in AJD drilling with down hole recirculation.

In embodiments of the method according to the invention, durations of said first and second time period are set and/or adjusted, e.g. during said rotating of the drill bit, based on downhole measurements. These measurements may include one or more of:

- detection of particles directly downstream of the first and second outlets,
- detection of a position, e.g. an azimuthal position, at which said impingement with the borehole bottom takes place,
- detection of a geometrical direction of the deepening of the borehole.

Other measurements, e.g. as commonly employed in a MWD-unit, may be included as well.

Embodiments of the system according to the invention thereto comprise one or more sensors. These sensors may include one or more of:

- one or more positional sensors, configured to, and arranged on the drill bit such as to provide a signal to the control unit indicative of the position, e.g. the azimuthal position, at which said impingement with the borehole bottom takes place,
- one or more presence detection sensors, e.g. high frequency acoustic sensors or magnetic sensors, arranged at a location downstream of said deflection, e.g. at the first and second inlets and/or at the first and second outlets and/or close to the drill bit, configured to provide a signal to the control unit indicative of the presence of abrasive particles at said location, e.g.

indicative of the passing of said first stream portion or said second stream portion, one or more navigational sensors, configured to, and arranged on the drill bit such as to provide a signal indicative of a geometrical direction of said deepening of the borehole. the control unit being configured to, based on signals of the sensors, control the actuators of the particle deflection device.

In an embodiment one or more presence detection sensors are provided at one, or both of the first and second channel. For example, a presence detection sensor is provided near or at the channel inlet(s), to monitor the particles entering the channel(s), and/or near or at the channel outlet(s), to monitor the particles leaving the channel(s), e.g. to verify the end result of the generation of the first and second stream portion by the modulation unit, and/or elsewhere along the channel.

In an embodiment, one or more of the presence detection sensors are configured for providing a signal indicative of the number of abrasive particles present, e.g. the number of abrasive particles passing the sensor, e.g. per unit of time, e.g. per unit of drilling fluid of the stream.

In an embodiment one or more, e.g. one, presence detection sensors are provided at one of the first and second channel, e.g. only at the first channel.

In an embodiment one or more presence detection sensors are provided at the supply channel, e.g. near the outlet thereof. In an embodiment one or more presence detection sensors are provided at the drill bit, e.g. at or near the bit fluid inlet port, the intermediate space, or nozzle(s).

In an embodiment wherein the abrasive particles are magnetic abrasive particles, e.g. a steel shot, one or more of the presence detection sensors are magnetic sensors in the particular form of inductive magnetic sensors or magnetometers, configured for providing a signal indicative of the number of abrasive particles present in the stream passing the sensor. The inductive magnetic sensors are known in the art e.g. for measuring the static level of magnetic particles in a container, e.g. a tube, alike in US2010243240, by measuring the self-inductance in the coils. This self-inductance of the coils varies with the number of magnetic abrasive particles present inside the coil, and is determined by the ratio of the voltage and the rate of change of the current in time. When a varying AC current is ran through the coil, the self-inductance can be determined by an accurate voltage and current measurement during the process. Alternatively, the magnetic field induced by the coil, which increases with the number of particles inside the coil, may be measured to determine the number of particles. For this purpose e.g. a Hall probe may be arranged at or near the sensor location, which is known in the art for example from its use in linear displacement sensors (LVDT's) and linear motors. In case of a magnetic field measurement e.g. by a Hall probe, a correction for the magnetic field of the earth may be provided in processing and interpreting the measurements.

Other than in the prior art, in this embodiment of the invention, the inductive coils are arranged around a flow of abrasive particles through the drilling system in the stream of drilling fluid towards the nozzles, for determining the concentration and/or flow rate of the abrasive particles.

In an embodiment, one or more induction coils are arranged around the supply channel, e.g. at or near the supply channel outlet. In an embodiment, one or more inductive coils are arranged around the first channel of the modulation unit, e.g. at or near the first inlet, in an axial center portion of the first channel, and/or at or near the first outlet. In an embodiment, one or more coils are arranged around the second channel of the modulation unit, e.g. at or near the second inlet, in an axial center portion of the second channel, and/or at or near the second outlet. In an embodiment, one or more coils are arranged at or near the bit fluid inlet, the bit intermediate space, and/or the nozzle(s).

In an embodiment, at least one coil is arranged at a location along the stream of abrasive particles for determining the concentration of abrasive particles passing the coil.

In an embodiment, at least two coils are arranged at axially spaced locations along the stream of abrasive particles for determining the flow rate of abrasive particles passing the two coils, by comparing the measurements by the two or more coils of the number of particles passing the coil and the timings at which the particles pass the two coils.

In an embodiment, at least two coils are arranged at axially spaced locations along the stream of abrasive particles for determining variations in concentrations along the stream, e.g. along or between the channels.

In an embodiment, at least one coil is arranged in the drill bit for measuring the concentration of the passing abrasive particles over time during rotation of the drill bit, for determining the timings of the passing of the first and second stream portions through the nozzle(s), in combination with a determination of the angular location of the nozzle(s), for the purpose of synchronizing the passing of the first and second stream portions through the nozzle(s) with the angular sector of the borehole bottom that needs enhanced erosion for directing the borehole in a direction away from that section.

In a particular embodiment, an induction magnetometer is arranged around the stream at or near the inlet of one of the channels, e.g. the first channel, and at or near the outlet of the same channel, and not at the other one of the channels, e.g. the second channel. In case the particles are deflected in the first and second channel, during the first and second time period, respectively, the particles have a lower velocity in one of the channels, for example the first channel, than in the other one of the channels, for example the second channel. It is preferred that the induction magnetometers are arranged around the stream at the channel with the lower velocity for the sake of measurement accuracy. In the discussed embodiment wherein the first channel is arranged inside the second channel, the coils may advantageously arranged at the first channel.

In a particular embodiment, one induction magnetometer is arranged around the stream at the supply channel, e.g. near or at the outlet thereof, two induction magnetometers around the first channel, namely at or near the inlet, and at or near the outlet thereof, and one induction magnetometers at or near the drill bit, e.g. at or near the fluid inlet, e.g. directly upstream of the fluid inlet. In an embodiment wherein the particle deflection device comprises a particle concentration device, the induction magnetometer around the supply stream may be arranged at the concentration device, e.g. near the outlet thereof, e.g. directly downstream of the outlet thereof.

In a practical embodiment, the coils arranged at one or more of the channels are embedded in the wall of the respective channel. An axial ferromagnetic guide may be arranged on the exterior of the coil.

The invention furthermore relates to the use of one or more induction magnetometers for measuring the concentration and/or flow rate of the abrasive particles in the stream of drilling fluid mixed with abrasive particles in the directional drilling system, according to any of the embodiments described.

The control unit may be connected to the one or more sensors of the directional drilling system such as to receive signals provided thereby, comparing the values represented by said signals with a predetermined reference value of quantities measured thereby, and/or with previous values, and/or values of other sensors, and produce in dependence of the result of said comparing, said control signals to the different actuators of the system. In a practical embodiment, the control unit employs a control loop for controlling the generation of the first and second stream portion by the modulation unit. In particular, the control unit may be based on the sensor measurements adjust the timing and duration of the deflection into either of the channels by the particle deflection device. Furthermore, the concentration of the supply stream may be altered, and/or the flow resistance(s) of the channel(s) of the modulation unit.

The particle detection may in particular be used, e.g. by the control unit, to calculate the velocities, e.g. flow rates, of the abrasive particles through the channels and the expected arrival time of the abrasives at the borehole bottom, and to adjust said timing and duration of the first and second period in order to match the rotational velocity of the drill bit such that the high concentration stream portions reach the selected angular sector of the borehole bottom the moment the abrasive jet nozzles are aimed thereat.

In particular the particle detection may be used, e.g. by the control unit, to determine the concentration difference between the subsequent stream portions, in order to obtain feedback on, and control the differential holemaking. Sensors for the detection of the concentration difference, as used by the control unit, e.g. HF-acoustic sensors or magnetic sensors, are preferably arranged along the stream inside, on, or close to, the drill bit for this purpose. The positional and navigational sensors may be used for obtaining feedback on the direction and rotational position of the drill-bit, inclination, azimuth, and toolface with respect to the local earth magnetic field and the gravitational vector g. This feedback may e.g. be used to control the modulation device, adjusting thereby the drilling direction where necessary.

The modulation device might be a number of meters away from the drill bit. But the surveying and/or directional sensors are preferably located close to the drill bit. All relevant distances are known to the control unit of the system. Advantageously, in pure AJD drilling systems, directional sensors may be located closer to the drill bit—which may facilitate a more accurate steering.

The control unit may employ simple or complex directional objectives for the drilling. The functionality of the control unit can be upgraded by applying model based process control. Preferably an algorithm is provided which derives the string rotational velocity and the toolface angle of the abrasive jet nozzles that the abrasive jet passes through.

In an embodiment, the control loop comprises a large control loop with a directional controller, and a small control loop with a concentration modulation controller.

In the large control loop, the directional controller has as an input a directional objective. Measurements of sensors at the drill bit, including e.g. positional sensors, e.g. accelerometers in three directions, gyroscopic sensors in three directions, magnetic sensors, e.g. magnetometers, in three directions, in particular for detecting the orientation of the bit relative to the earth magnetic field, particle presence detection sensors, e.g. three, and/or geographical data are fed into a directional controller which controls based on the measurements and the directional objective the directional action, the rotation, phase, and radius of the drill bit. The directional controller furthermore stores these data in a memory, and outputs to the surface if and to what extent the directional objective is achieved. The directional controller furthermore utilizes the response of a concentration modulation controller of a small control loop as a basis for its actions.

In the small control loop, the concentration modulation controller has as its input the output of the directional controller of the large loop, and sensor measurements including temperature, flow rate, pressure, and particle presence detection, in particular in the form of quantity measurements of the abrasive particles. The concentration modulation controller controls the modulation action of the modulation unit, including the deflection of particles into the channels. The response of the modulation unit is fed back into the controller for verification of achieving the control objective. The control actions of the controller are as mentioned above also fed back to the directional controller of the large control loop. The control actions are also stored in a memory.

The large control loop is e.g. executed in a time span in the order of multiple minutes, typically more than 10 minutes. The small control loop is typically faster than a minute.

The invention furthermore relates to a method and system for controlling the concentration and/or flow rate of the abrasive particles in the stream of drilling fluid mixed with abrasive particles in the directional drilling system based on the presence detection sensors, e.g. in particular the induction magnetometers, according to any of the embodiments described.

The invention may integrate mud pulse telemetry, commonly employed in drilling systems for drilling into earth formations. Typical mud pulse telemetry systems include a send and receive facility on a drilling unit at the surface while drilling into a subterranean earth formation as an object, and a send and receive equipment down hole, often integrated with the down hole measurement while drilling (MWD) equipment. Information important to send from surface to the down hole equipment could for instance be a signal to change from a first directional objective, for example to build an inclination to e.g. 70 degrees, to a second control objective, for example to drill e.g. a 30 degrees turn to the left. Information important to send to the surface might for instance be a confirmation that a new setting has been received, the achievement of a directional objective, the detection of drilling into a new rock type or an alarm triggered by a hardware failure. In the current invention, the communication of down hole information to the surface can be accomplished by making use of hardware components close to the first and second channel, e.g. in a down hole steering sub with the first and second channel. This advantageously removes the need for adding a down hole pulser and a separate down hole telemetry control electronics to the drilling assembly. The rest of the mud pulse telemetry system may be embodied as is commonly employed in drilling systems for drilling into earth formations.

The mud pulse telemetry may in the current invention be used e.g. to transfer the signals from the sensors, when present, to the control unit, e.g. when the latter is arranged externally from the borehole, e.g. when the object is an earth formation, at the surface of said earth formation. In the current invention the mud pulse telemetry may in particular advantageously be realized within the first and second channel, deliberately partly blocking the channels to generate the pressure pulses—thereby advantageously making use of the reduced diameter through which the abrasive particles are passed. The telemetry mode is preferably only used in a tangent steering phase, e.g. wherein said deflection is not taking place, when the steering correction is limited and the loss of steering time while producing the telemetry pulses can be easier to facilitate. The mode can however also be used while drilling a bent section and executing the method according to the invention.

In an embodiment of the method according to the invention wherein the abrasive particles are magnetic particles, the method further comprises, for this purpose:

activating a magnetic field in the first and/or second channel during a time interval such as to cause a local accumulation of magnetic abrasive particles in said first and/or second channel that results in a pressure pulse within that channel, subsequently, deactivating said magnetic field, wherein said activation and deactivation are repeated to create a series of pressure pulses over time, of which the amplitudes and timing are determined such that said series of pressure pulses represents one of said downhole measurements for use in a mud pulse telemetry system, e.g. down hole information to be communicated to receiver of the telemetry equipment at a drilling unit at a surface in case the object is a subterranean earth formation.

In an embodiment of the system according to the invention wherein the abrasive particles are magnetic particles, the system further comprises, for this same purpose, a mud pulse telemetry unit. This mud pulse telemetry unit comprises:

a telemetric control unit, typically with a wired connection to a steering sub with said first and second channel, or e.g., forming an integrated component of such a steering sub, configured to receive one or more of said signals provided by said one or more sensors, e.g. deriving therefrom the information to be sent to the surface, in case the object is a subterranean earth surface, from the down hole electronics, and to encode these into series of pulses with predetermined timings and amplitudes, and a switchable magnet arranged such as to produce in the first and/or second channel a magnetic field, configured to during activation thereof, cause a local accumulation of magnetic abrasive particles in said first and/or second channel that results in a pressure pulse within that channel, and upon deactivation thereof, stops said causing of said local accumulation.

Therein said telemetric control unit is configured to control the activation and deactivation of the switchable magnet such that the switchable magnet repeatedly produces said pressure pulse to form a series of pressure pulses of which the timings and amplitudes correspond to said encoded series of pulses e.g. detected by a receiver of the telemetry system on the drilling unit at surface, in case the object is a subterranean earth surface.

The mud pulse telemetry unit may further comprise, downstream of the first and second channel, e.g. externally from the borehole, e.g. when the object is an earth formation, at the surface of said earth formation, a conversion device connected to the control unit. The conversion device is adapted to register the timings and amplitudes of said series of said pressure pulses and to produce corresponding signals to the control unit, e.g. a series of voltages with corresponding timings and amplitudes. The control unit, e.g. also arranged externally from the borehole, e.g. when the object is an earth formation, at the surface of said earth formation, close to the conversion device, is configured to decode the mentioned corresponding signals produced by said conversion device into quantities measured by said one or more sensors, to compare said values with a predetermined reference value of said quantity, and produce in dependence of the result of said comparison, the mentioned control signals to the particle deflection device.

It is submitted that, although the above discussion refers only to a first and a second channel, the concept allows for using more channels. For example a first, second, and third channel may be used to split the flow into a first, second and third sub flow. In one such a method, the three sub channels each have a different flow resistance, and the abrasive particles are deflected into at least two of the first, second, and third channel during at least two of a first, second and third time period. The difference between a flow resistance to the drilling fluid mixed with abrasive particles results in a difference between the velocities, at which the drilling fluid mixed with abrasive particles flows through the respective channels. The differences between the three velocities, and thus between the three flow resistances, are such that, downstream of the outlets of the three channels, the majority of abrasive particles deflected into the first channel, the majority of abrasive particles deflected into the second channel, and/or the majority of abrasive particles deflected into the third channel, during the respective first, second and third time period, will at least partially overlap, as they, together with the drilling fluid passed through those channels during said time periods, are combined to form the first stream portion. The minorities of abrasive particles not being deflected during the first, second and/or third time period, i.e. the abrasive particles passing into the channels other than the one into which the majority of the abrasive particles are deflected during the time periods, together with the drilling fluid passed through those channels during said time periods, respectively, form the second stream portion. In an embodiment, one of the sub flows is a main sub flow, of which sub flow the concentration of particles is not adjusted. Such a method comprises splitting the flow up into three or more sub flows. For example, a first, second, and third channel, are provided to split the flow into a first second, and third sub flow, wherein the first of said sub flows is a main sub flow, of which the particle concentration is not adjusted, and the second and third sub flows are used to generate an alternating particle concentration. In such a method, the flow is first subdivided into a sub flow that passes through the first channel and a sub flow that passes through the second and third channel. In such a method, the latter flow is the flow that passes through the supply channel outlet. Thus, in such a method the supply channel outlet is located downstream of the location at which the flow is split into a sub flow of which the particle concentration is not adjusted, and a sub flow of which the particle concentration is adjusted by passing it through two sub channels. The flow that is to be guided through the second and third channel is manipulated by a deflection device. The deflection device is configured to alternatingly, during a first time period, deflect into the second channel a majority of all abrasive particles in the stream that pass through the supply channel outlet, and during a second time period, following the first time period, not deflecting into the second channel a majority of all abrasive particles in the stream that pass through the supply channel outlet. Preferably, during the second time period, a majority of all abrasive particles in the stream that pass through the supply channel outlet is deflected into the third channel. Thus, the flow of drilling fluid is split into two sub flows. A first sub flow that passes through the second channel, and a second sub flow that passes through the third channel. The second channel and the third channel have different flow resistances, such that one sub flow takes longer to pass through the channel than the other sub flow.

The difference between the respective flow resistances to the drilling fluid mixed with abrasive particles results in a difference between the velocities, at which the drilling fluid mixed with abrasive particles flows through the respective channels. The differences between the two velocities, and thus between the two flow resistances, is such that, downstream of the outlets of the second and third channel, the majority of abrasive particles deflected into the second channel, the majority of abrasive particles deflected into the third channel, will at least partially overlap, as they, together with the drilling fluid passed through those channels during said time periods, are combined downstream of the outlets of the second and third channel. Furthermore, the flows exiting the outlets of the second and third channel are also combined with the main flow, i.e. the flow that is passed through the first channel. Together the three sub flows form a flow comprising alternatingly a first stream portion, comprising the enhanced flow concentrations generated in the second and third channel, and a second stream portion, comprising the reduced flow concentrations generated in the second and third channel.

In a system employing three channels, the control system and the deflection device are configured to deflect abrasive particles into the first, second, and third channel during a first second and third time period. In an alternative system, a first, second, and third channel are provided, to split the flow into a first, second and third sub flow, wherein one of the three sub flows is a main sub flow, of which main sub flow the concentration of particles is not adjusted. In such a system, the flow is first subdivided into a sub flow that passes through the first channel and a sub flow that passes through the second and third channel. In such a system, the latter flow is the flow that passes through the supply channel outlet. Thus, in system the supply channel outlet is located downstream of the location at which the flow is split into a sub flow of which the particle concentration is not adjusted, and a sub flow of which the particle concentration is adjusted by passing it through two sub channels.

The invention also relates to a sub according to claim 23, and to an abrasive particle pulse generator according to claim 24. It is noted that embodiments discussed herein in relation to the system also relate to said sub and said abrasive particle pulse generator to provide the same or similar advantages in as far as the same or similar features are provided.

Throughout the disclosure, the word 'fluid' in terms alike 'fluid communication', 'fluid connection' 'fluid inlet port', 'fluid outlet port', is to be interpreted as including fluid that is mixed with abrasive particles. That is, for instance, a 'fluid inlet port' is suitable for letting in drilling fluid mixed with abrasive particles.

BRIEF DESCRIPTION OF THE DRAWINGS

The invention will now be described with reference to the appended drawings. In the drawings.

DETAILED DESCRIPTION OF EMBODIMENTS

The figures illustrate embodiments of a directional drilling system 1 according to the invention.

Figure 1:
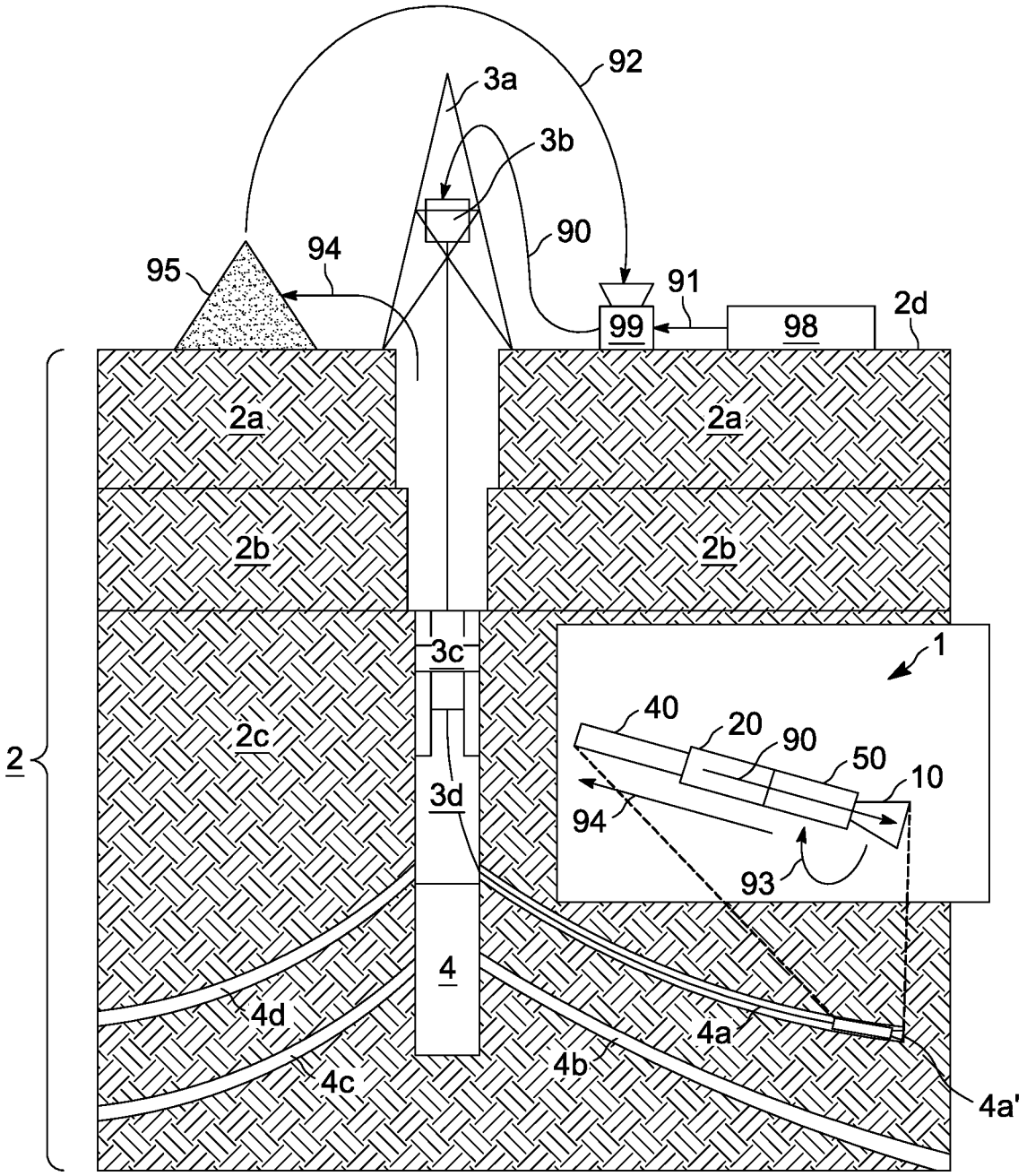
FIG. 1 schematically shows a system according to the invention being used for directional drilling of a curved borehole in a subterranean earth formation, FIG. 2 schematically shows embodiments of a system according to the invention, along with magnifications of a mechanical drill bit thereof and of the interior of a steerable sub thereof, FIG. 3 schematically shows a system according to the invention during use, during a first time period, FIG. 4*a* schematically shows a top view of cross-section A-A indicated in FIG. 3 of the system of FIG. 3, during a first time period, FIG. 4*b* schematically shows a top view of cross-section A-A indicated in FIG. 3 of the system of FIG. 3, during a second time period, FIG. 5*a* schematically shows a system according to the invention during use, during a first time period.

FIG. 1 illustrates, highly schematically, an embodiment of the system 1 while directional drilling of a curved borehole 4*a* in a subterranean earth formation 2. The drilling has progressed through limestone layer 2*a* and sandstone layer 2*b* into a rock layer 2*c* of the subterranean earth formation. As best seen in the magnification of the system 1, the system 1 is connected to a drill string 40, which is rotated by top drive 3*b* of drilling tower 3*a* at the surface 2*d*. Within the cement casing of a main, vertical borehole 4, an anchor 3*c* is arranged and a whipstock 3*d*, which guides the drill string 40 through the casing to deviate into borehole 4*a*. Borehole 4*a* is the last of four curved boreholes 4*a*, 4*b*, 4*c*, 4*d* deviating from the main borehole 4 being drilled. All deviating curved boreholes 4*a*, 4*b*, 4*c*, 4*d* comprise a curved section and a subsequent straight section. System 1 is currently deepening the straight section of borehole 4*a*. Borehole 4*a* has a borehole bottom 4*a*'.

At the surface 2*d*, besides the tower 3*a* and top drive 3*b*, a pump 98 is provided which pumps drilling fluid 91 through a particle injection device 99. In particle injection device 99, magnetic abrasive particles 92 from an abrasive particles supply 95 are combined with the drilling fluid 91 to form a stream 90 of drilling fluid 91 mixed with abrasive particles 92. The stream 90 has a substantially constant flow rate and concentration of abrasive particles 92. The stream 90 is passed through a supply channel that runs through the drill string 40 into the system 1, inside which it runs subsequently through a steerable sub 20 and a recirculation sub 50 and drill bit 10. The drill bit 10 is in this case an abrasive jet drill bit. After passing the drill bit 10, the stream 90 impinges the borehole bottom 4*a*' in the form of an abrasive jet of said stream 90, so as to erode the borehole bottom 4*a*'. After this impingement, the stream 90 progresses upwardly again towards the surface 2*d*, moving in between the annular space in between the cylindrical borehole wall and the system 1. While passing the recirculation sub 50, a portion of the abrasive particles 92 inside the stream is captured by the recirculation sub 50, and recirculated within the recirculation sub as a recirculation stream 93 to the stream 90. After the capture of the abrasive particles 92 by the recirculation sub from the stream 90, it progresses further towards the surface as return stream 94. The particles 92 still left in the recirculation stream 94 are filtered at the surface 2*d* to join the supply 95 of abrasive particles.

Figure 2:
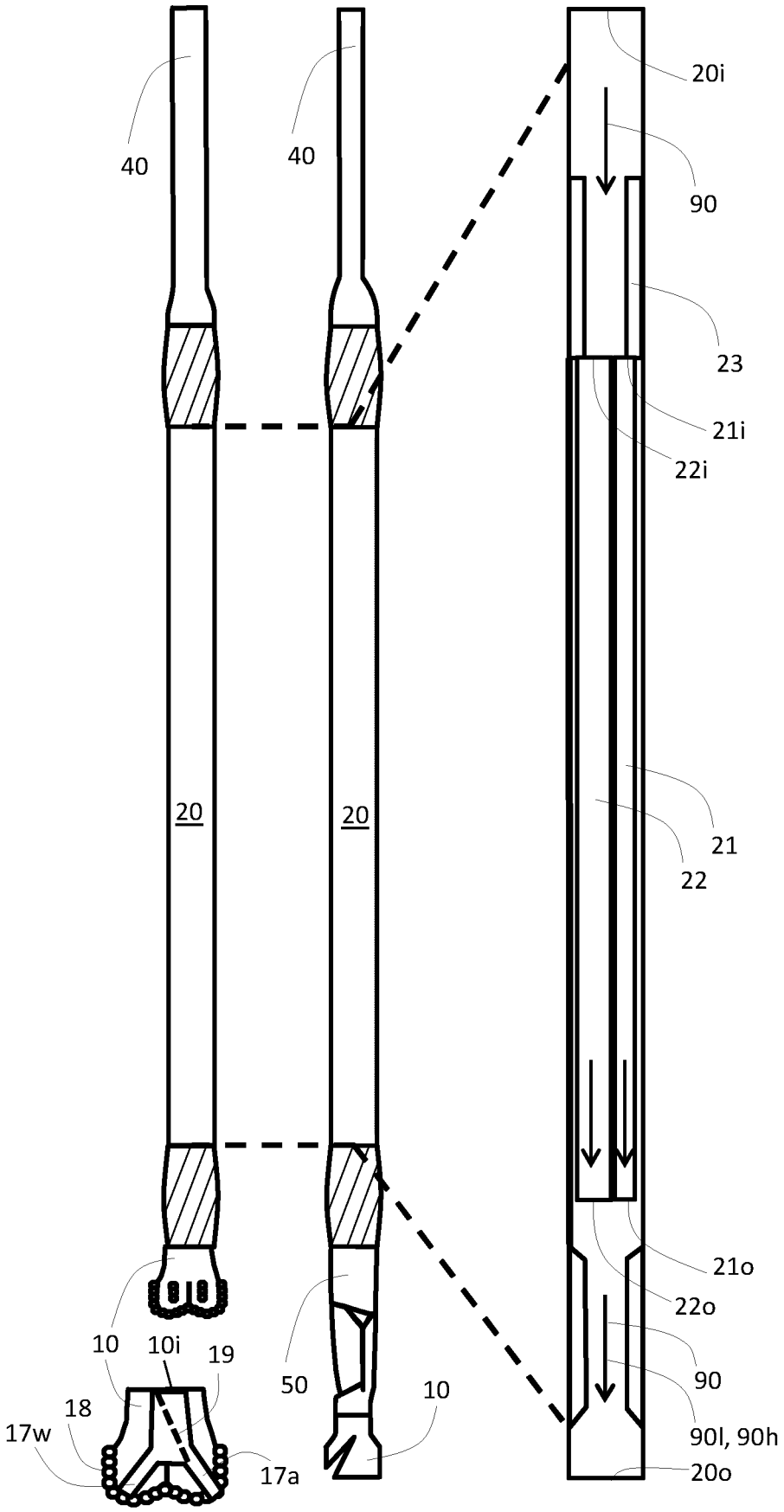

FIG. 2 shows, schematically, two possible embodiments of a system 1 according to the invention. Both have an identical steerable sub 20, the interior of which is shown schematically to the right of both embodiments in a magnification. In the leftmost system 1, the drill bit 10 is a mechanical drill bit. In the rightmost system 1, the drill bit 10 is an abrasive jet drill bit, and the system comprises a recirculation unit 50. The recirculation unit 50 and the AJD bit of this system is shown in more detail in FIG. 7.

As indicated for the mechanical drill bit 10 in a magnification thereof, the drill bit 10 comprises a bit face, which during use faces the borehole bottom 4*a*', a bit fluid inlet port 10*i*, one or more abrasive jet nozzles 17*a* and an intermediate space between the bit fluid inlet port 10*i* and one or more abrasive jet nozzles 17*a*. These parts are also comprised by the abrasive jet drill bit of the rightmost embodiment, as shown in FIG. 7.

The abrasive jet nozzles 17*a* are configured for ejecting stream 90 of drilling fluid 91 mixed with abrasive particles 92 into impingement with the borehole bottom 4*a*' in the form of an abrasive jet 90. The mechanical drill bit comprises multiple abrasive jet nozzles 17*a* arranged at different azimuthal positions. The AJD drill bit has only one single abrasive jet nozzle 17*a*, as shown in FIG. 7.

Each of the abrasive jet nozzles 17*a* have a nozzle inlet for fluid communication with the intermediate space, from which each of the nozzle inlets extends at least during rotation of the drill bit 10.

The mechanical drill bit 10 further comprises wash nozzles 17*w*, mechanical cutters 18, and a strainer 19. The strainer is configured and arranged within the drill bit 10 such that the abrasive particles from the stream 90 are deflected into the abrasive jet nozzles 17*a* only, and the drilling fluid 91 from the stream 90 passes into both the abrasive jet nozzles and into the wash nozzles 17*w*.

Both embodiments of the system 1 further comprise the same sub 20, which is connected at a downhole end thereof to the drill bit 10 so as to be rotatable along therewith, and at another end thereof to the tubular drill string 40.

The sub 20 comprises a sub fluid inlet port 20*i*, fluidly connectable to the supply channel through the drill string 40 to receive from this supply channel the stream 90 of drilling fluid 91 mixed with abrasive particles 92 when the system 1 is connected to the drill string 40. It further comprises a sub fluid outlet port 20*o*, fluidly connected or connectable to the bit fluid inlet port 10*i*.

The sub 20 further comprises, fluidly connected to the sub bit inlet port 20*i*, downstream thereof, a modulation unit configured to cause a variation of a concentration of abrasive particles 92 along stream portions 90*h*, 90*l* of the stream 90 received from the supply channel that are subsequently passed through the sub bit fluid outlet port 20*o* into the bit fluid inlet port 10*i*.

The modulation unit comprises a first channel 21 and a second channel 22. The first channel 21 has a first flow resistance to the drilling fluid 91 mixed with abrasive particles 92, a first inlet 21*i*, and a first outlet 21*o* fluidly connected to the sub bit fluid outlet port 20*o*. The second channel 22 is arranged in parallel to the first channel 21, and has a second flow resistance to the drilling fluid 91 mixed with abrasive particles 92, a second inlet 22*i*, and a second outlet 22*o* fluidly connected to the sub bit fluid outlet port 20*o*.

Figure 3:
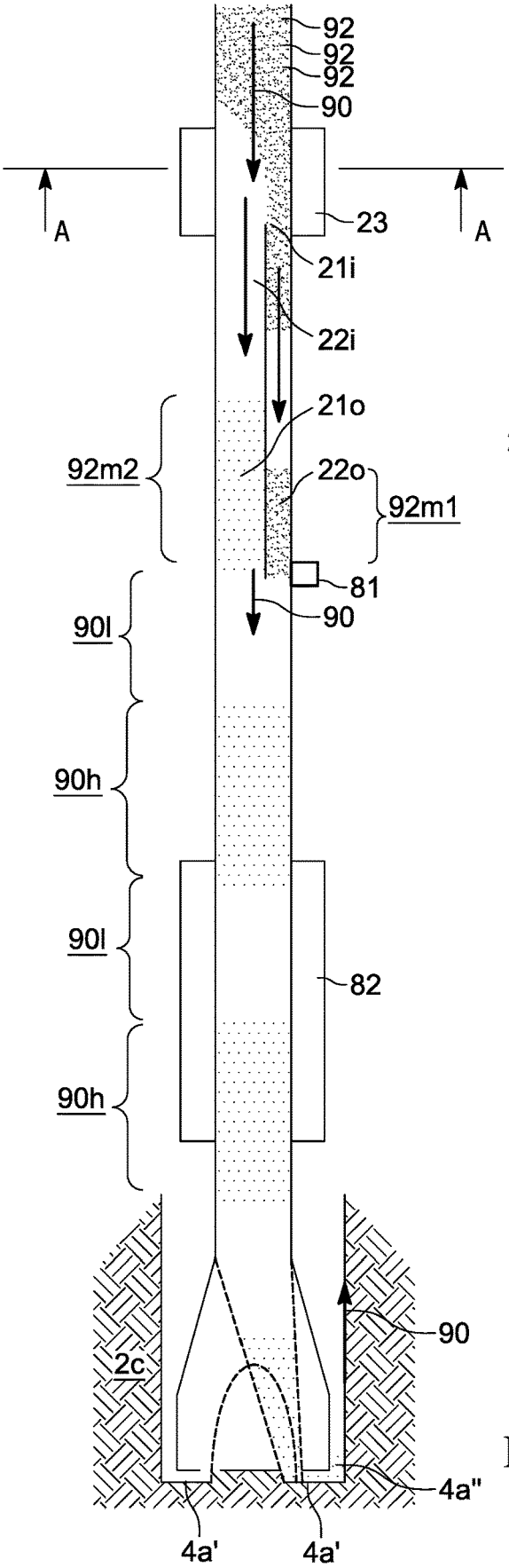

The modulation unit further comprises a particle deflection device 23 between the sub bit fluid inlet port 20*i* and the first and second inlets 21*i*, 22*i*. The particle deflection device is indicated in FIGS. 2 and 3, and is shown in more detail in FIG. 4, in a top view of a cross-section A-A as indicated in FIG. 3. It comprises one or more actuators 23*m*, and is connected to a control unit (not shown) of the system 1.

The particle deflection device 23 is configured to periodically, based on control signals received from the control unit, during a first time period, deflect a first majority 92*m*1 of all abrasive particles 92 received from the supply channel through the sub bit fluid inlet port 20*i* into the first inlet 21*i*, and during a second time period following the first time period, deflect a second majority 92*m*2 of all abrasive particles 92 in the stream 90 received from the supply channel through the sub bit fluid inlet port 20*i* into the second inlet 22*i*.

FIG. 3 illustrates the particle deflection device 23 deflecting a first majority 92*m*1 into the first channel 21.

Figure 4A:
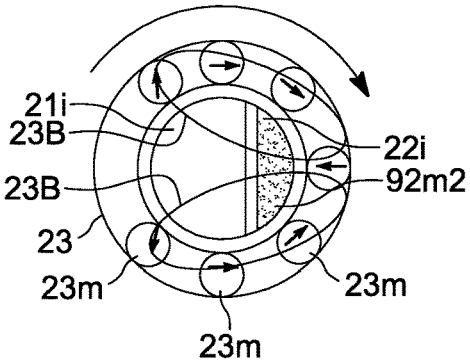
Figure 4B:
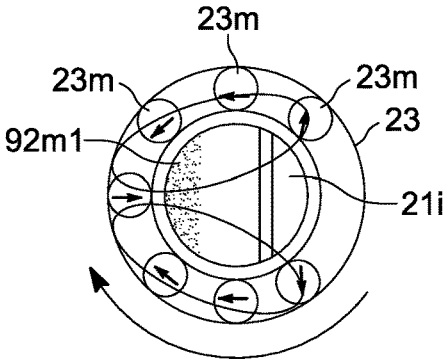

The first and second channel 21, 22 are straight channels with equal internal surface roughness and both have a constant cross-section along their lengths, namely the cross-section shown in FIGS. 4*a* and 4*b*. Together they form a cylinder. Because they are separated by one plate-shaped wall, they have equal lengths and start and end at the same location along the stream. Because the cross-sectional areas of the channels 21 and 22 are not equal to each other, there is a difference between the first flow resistance and the second flow resistance. This difference in flow resistances results in a velocity difference between said first majority 92*m*1 of abrasive particles 92 passing through said first channel 21 and said second majority 92*m*2 of abrasive particles 92 passing through said second channel 22. The flow resistance of the first channel 21 is larger than that of the second channel 22, because its cross-sectional area is smaller than that of the second channel 22. Therefore the first majority 92*m*1 travels slower through the first channel 21 than the second majority 92*m*2 travels through the second channel 22.

The velocity difference is such that in a combination section downstream of the first and second outlets 21*o*, 22*o*, the first and second majority 92*m*1, 92*m*2, together with any of said drilling fluid 91 passed into the first and second channel 21, 22 during the first and second time period, respectively, are combined into a first stream portion 90*h*. Minorities of abrasive particles 92 not being deflected, together with any drilling fluid 91 passed into the first and second channel 21, 22 during the second and first time period, respectively, are combined into a subsequent second stream portion 90*l*. In FIG. 3, a first and second majority are about to combine directly downstream of the outlets 21, 22.

In FIG. 3, the drill bit 10 is an abrasive jet drill bit (AJD bit). It has one single abrasive jet nozzle 17*a*. The bit face is devoid of any wash nozzles and mechanical cutters.

The control unit is configured such that the signals thereof received by the deflection device 23 cause the time periods in which the actuators 23*m* of the deflection device 23 deflect said first and second majority 92*m*1, 92*m*2 of the abrasive particles 92 into the first and second channel 21, 22 to be synchronized with the rotational velocity of the AJD bit 10 such, that said first stream portions 90*h* passes through the abrasive jet nozzle 17*a* while it is directed towards a selected angular sector 4*a*" of the borehole bottom 4*a*', together with any of said drilling fluid 91 passed into the first and second channels 21, 22 during the first and second time periods, respectively, and said subsequent second stream portion 90*l* passes through the abrasive jet nozzle 17*a* while it is not directed towards the selected angular sector 4*a*". In FIG. 3, a first stream portion is being ejected from the abrasive jet nozzle 17*a* being directed towards the selected angular sector 4*a*", impinging the selected angular sector 4*a*". The selected angular sector 4*a*" is to form the outer bend of the curved borehole section being drilled.

To illustrate the principle most clearly, the difference between the concentrations of the first stream portion 90*h* and the second stream portion is shown as 100%. That is, in the second stream portion 90*l* no abrasive particles 92 are present. In practice, this difference will be less than 100% when employing an AJD bit 10, to still accomplish some erosion of the borehole 4*a*' outside of the selected section 4*a*" as well, that is, at least deepening the inner bend of the curved borehole section to some extent. The concentration of abrasive particles determines the erosive power of the abrasive jet 90 being ejected, and therefore, the radius of the curved borehole section increases as the concentration difference between the stream portions 90*h*, 90*l* decreases.

The abrasive particles 92 are magnetic abrasive particles 92, namely ferromagnetic abrasive particles, and the actuators 23*m* of the deflection device 23 comprise a magnetic switch. The magnetic switch is shown in the top views of cross-section A-A of FIG. 3 directly upstream of the first and second inlets 21*i*, 22*i* in FIGS. 4*a* and 4*b*. FIG. 4*a* shows the magnetic switch during the first time period, that is, in the situation of FIG. 3. FIG. 4*b* shows the magnetic switch during the second time period.

This magnetic switch is configured to during the first time period establish an inhomogeneous magnetic field 23B over the shown cross-section that directs the abrasive particles 92 towards the first inlet 21*i* and to during the second period establish an inhomogeneous magnetic field 23B over the shown cross-section that directs the abrasive particles 92 towards the second inlet 22*i*.

The magnetic switch comprises multiple magnets 23*m* arranged at different azimuthal positions along an outer circumference of the stream 90 in the shown cross-section, namely along a circumference of a channel accommodating said stream 90 at that location. The multiple magnets 23*m* together produce the inhomogeneous magnetic fields 23B.

There are seven magnets 23*m* along the circumference. The arrows inside the magnets 23*m* indicate the direction of the N-poles thereof. They are directed relative to each other such as to produce the oval-shaped magnetic field lines over the cross-section. The magnets 23*m* are unevenly distributed along the circumference: in the first time period, most of the magnets 23*m* are at the side of the circumference of the first channel 21, see FIG. 4*a*, and in the second time period, most of the magnets are at the side of the circumference of the second channel 22, see FIG. 4*b*. As a consequence the density of the magnetic field 23B produced in the first time period is higher in a part of the cross-section covering the first channel 21 than in a part covering the second channel 22. As shown in FIG. 4*b* the density of the magnetic field 23B produced in the second time period is higher in the part of the cross-section covering the second channel 22 than in the part covering the first channel 21.

To achieve the different positions of the magnets 23*m* along the circumference, the magnets 23*m* are movable permanent magnets 23*m*, and the actuators further comprise drive means (not shown), connected to the magnets 23*m* and configured to move, based on the signals received from the control unit, the magnets 23*m* as a unity along the circumference upon a switch between the respective time periods. The movement is shown by the curved arrows along the circumference: in FIG. 4*a*, illustrating the first time period, the magnets 23*m* have just been rotated clockwise to direct the particles into the first channel 21, and in FIG. 4*b*, illustrating the second time period, the magnets 23*m* have just been rotated counter clockwise to direct the particles into the second channel 22.

The rightmost embodiment of the system 1 with the AJD bit 10 shown in FIG. 2, the system 1 further comprises a recirculation unit 50 for recirculation of the abrasive particles 92 passed through the abrasive jet nozzles 17*a* into impingement with the borehole bottom 4*a*'. This recirculation unit 50 is shown in more detail in FIG. 7. The downhole recirculation unit 50 comprises a magnet 51, which is arranged such that one or more magnetic fields produced thereby attract abrasive particles 92 from the stream 90 downstream of said impingement thereof with the borehole bottom 4*a*'. Thereafter it conveys the attracted particles 92 in a recirculation stream 93 at a substantially constant flow rate to a mixing section 52*c* of channel 52 of the recirculation unit 50, through which said stream 90 passes towards the abrasive jet nozzle 17*a* after it has passed the steerable sub 20.

As shown in FIG. 3, the system 1 further comprises one or more sensors 81, 82. These sensors include positional sensors 82 which are configured to, and arranged directly above the drill bit 10 such as to, provide a signal to the control unit indicative of the position at which said impingement of the stream 90 with the borehole bottom 4*a*' takes place. The sensors furthermore include navigational sensors 82, configured to, and arranged on or directly above the drill bit such as to provide a signal indicative of a geometrical direction of said deepening of the borehole 4*a*.

The sensors also include presence detection sensors 81, in the form of high frequency acoustic sensors or magnetic sensors, arranged at a location directly downstream of said first and second outlets 21*o*, 22*o*. These presence detection sensors 81 are configured to provide a signal to the control unit indicative of the presence of abrasive particles 92 at that location. These signals at least indicate of which of said first stream portion 90*h* or said second stream portion 90*l* passes the sensors 81.

The control unit is configured to, based on signals of the sensors 81, 82, control the actuators 23*m* of the particle deflection device 23.

The control unit is connected to the one or more sensors 81, 82 such as to receive signals provided thereby, and is configured to compare the values represented by said signals with a predetermined reference value of quantities measured thereby, and produce in dependence of the result of said comparing, the mentioned control signals to the particle deflection device 23.

Figure 5A:
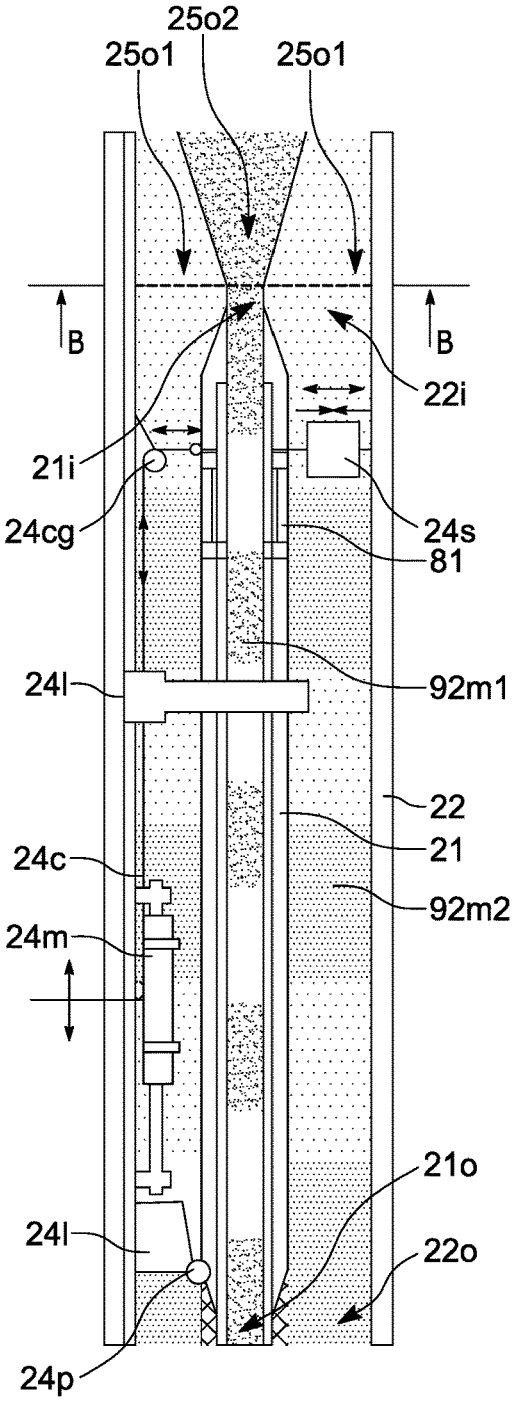
FIG. 5*b* illustrates schematically the action of the deflection device in the system of FIG. 5*a*, FIG. 6 schematically shows a system according to the invention during use, during a first time period along with the action of the deflection device, FIG. 7 schematically shows a recirculation sub and a drill bit being used within a system according to the invention.
Figure 5B:
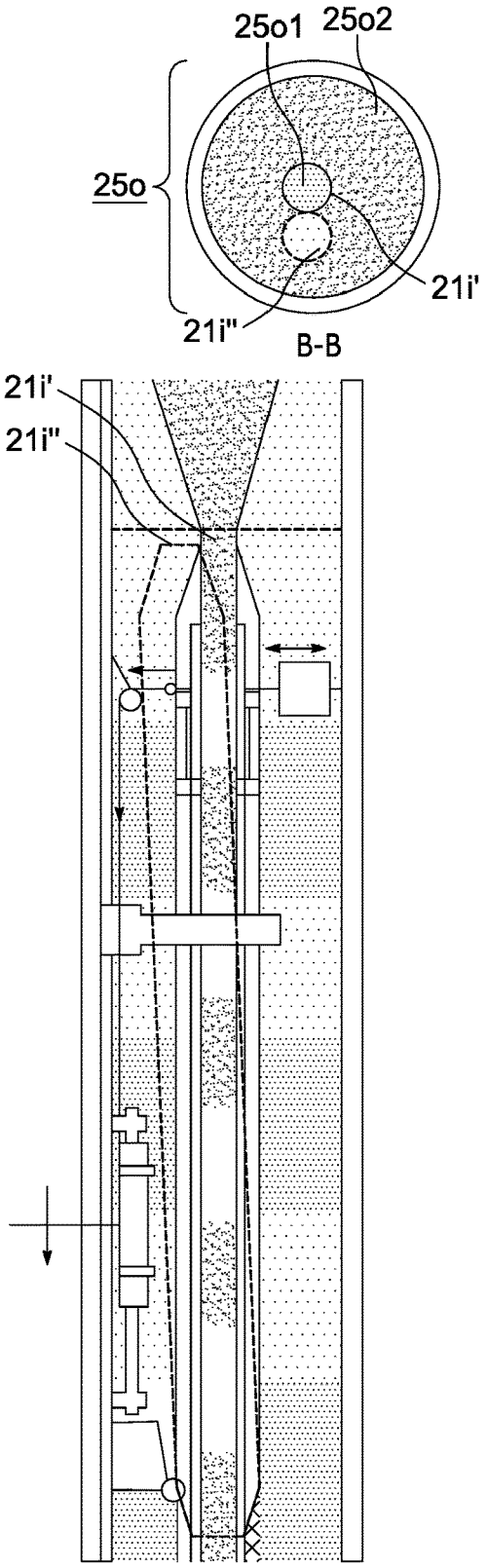
Figure 6:
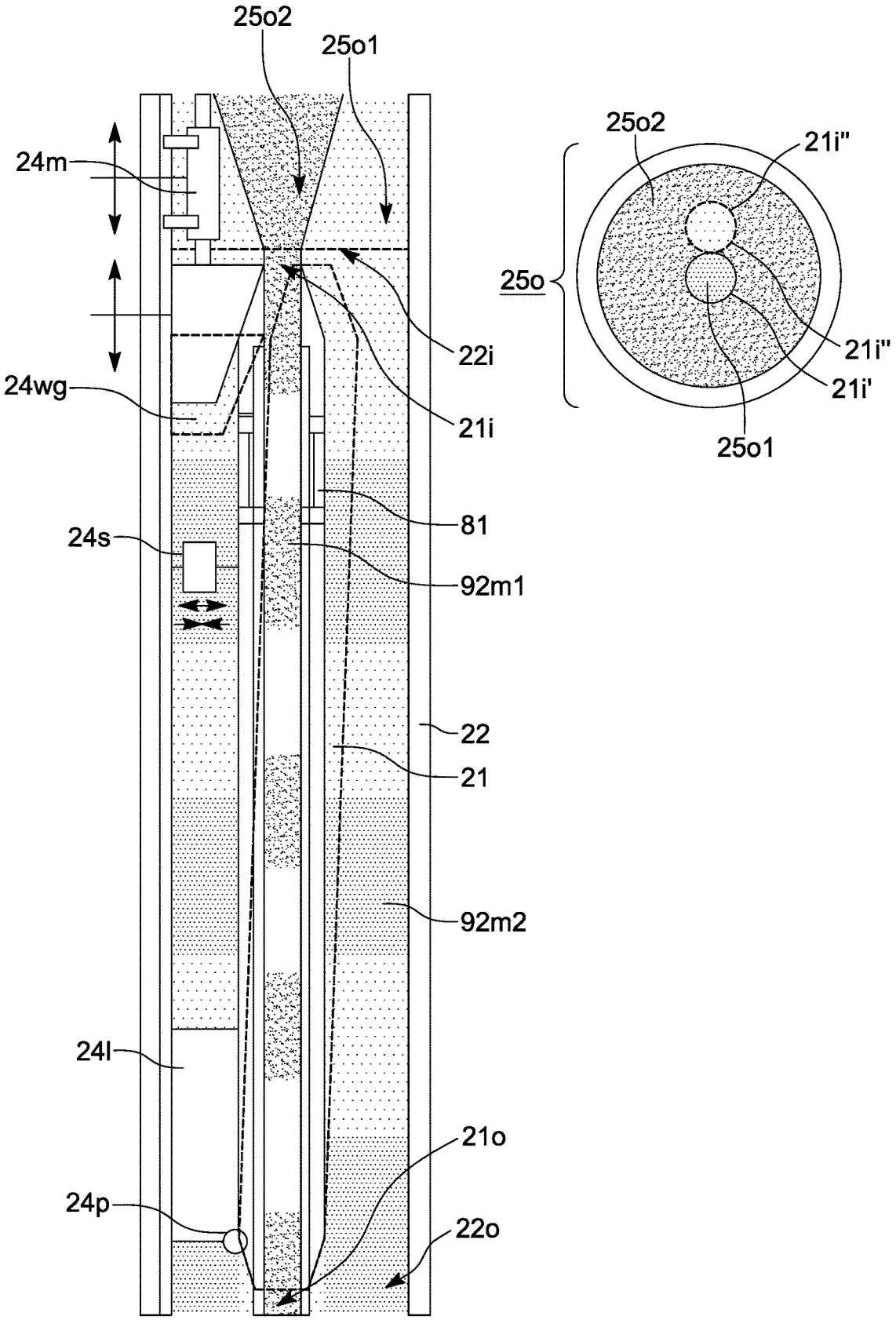

FIGS. 5*a-b* and 6 illustrate an embodiment with a different particle deflection device 24 and a different arrangement of the first and second channel. Instead of being radially adjacent, the first channel 21 is, arranged inside the second channel 22 so that the first channel is radially enclosed by the second channel. Furthermore the deflection of the particles into the channels 21, 22 is established by mechanical, instead of magnetic, deflection means. A particle concentrating device 25 is arranged directly upstream of the first and second inlet 21*i*, 22*i*, between the supply channel outlet and the first and second inlets 21*i*, 22*i*. Through this concentrating device 25 the abrasive particles are supplied in a higher concentration in a first cross-sectional portion 25*o*1 of an outlet 25*o* thereof than in a second cross-sectional portion 25*o*2 of this outlet. A radial moving of the first inlet 21*i* relative to the first and second portion 25*o*1, 25*o*2 makes that a smaller or larger cross-sectional portion of the first inlet 21*i* is within the contours of the first and second portion 25*o*1, 25*o*2, so that the respective inlet receives a higher or lower concentration of abrasive particles 92. The relative radial movement is driven by an actuator mechanism of the deflection device 24.

The particle concentrating device 25 comprises an inlet fluidly connected to the supply channel outlet for receiving the stream 90 of drilling fluid 91 mixed with abrasive particles 92 from the supply channel, and the mentioned outlet 25*o*. The concentrating device 25 is configured to direct a majority of the abrasive particles 92 of the supply stream 90 into the first portion 25*o*1 of the outlet 25*o*, and a minority of the abrasive particles 92 into the second portion 25*o*2 of the outlet, so that the concentration, and thus the flow rate, of abrasive particles 92 is high in the first portion 25*o*1 and low in the second portion 25*o*2. In this example, the concentrating device 25 is a strainer. In effect, the concentrating device 25 forms an extension of the supply channel.

As illustrated in FIG. 5*b*, the first channel 21 is movable such that its inlet 21*i* is in a first position 21*i*' in which it is radially coincident within the contour of, and axially in line with, the first portion 25*o*1 of the outlet 25*o* of the concentrating device 25 during the first time period, so that the first inlet 21*i* receives the abrasive particles 92 of the supply stream 90 at the high concentration—and thus, flow rate. This position is shown both in FIGS. 5*a* and 5*b*. The first channel 21 is furthermore movable such that during the second time period, its inlet 21*i* is in a second position 21*i*" in which it is radially outside the contour of, and axially not in line with, the first portion 25*o*1 of the outlet 25 during the second time period, so that the first inlet does not receive, or receives less of, the abrasive particles 92 of the supply stream 90 at the high concentration—and thus, flow rate, so as to receive the abrasive particles at a lower concentration. This position is illustrated in FIG. 5*b* by the dashed lines of the outer contour of the first channel 21. The first inlet 21*i* is in the second position 21*i*" during the second time period radially inside the contour of the second portion 25*o*2 of the outlet 25*o* of the concentrating device 25, so as to receive the abrasive particles 92 of the supply stream 90 at a lower concentration.

To move the first inlet 21 into the first and second position 21*i*' and 21*i*" thereof, the first channel 21 is pivotable about a radially extending pivot axis 24*p* remote from the inlet 21*i* and near the outlet 21*o* of the first channel. The actuator mechanism of the deflecting device 24 is arranged in the second channel 22, and is configured to move the first channel 21 between the first and second position 21*i*',21*i*" of its inlet, by pivoting the first channel 21 around the pivot axis 24*p*.

As can be verified from FIGS. 5*a-b*, by the movement of the first inlet 21*i*, the second inlet 22*i* is simultaneously brought into and out of the contour of the first portion 25*o*1 of the outlet 25. In the second position 21*i*" of the first inlet 21*i*, the second inlet 22*i* is radially within the contour of, and axially in line with, the first portion 25*o*1 during the second time period, and radially within the contour of the second portion 25*o*2 during the first time period. The effect is that the first and second channel 21, 22 alternatingly—during the first and second time period receive the abrasive particles 92 of the supply stream 90 at a high concentration.

As can be verified from the detail of the cross-section B-B at the interface between the outlet 25*o* and the inlets 21*i*, 22*i* in FIG. 5*b*, the first portion 25*o*1 of the concentrating device outlet 25*o* is radially enclosed by the second portion 25*o*2. The first and second portion 25*o*1, 25*o*2 are concentric.

The first channel 21 is arranged inside the second channel 22 so that the inlet 21*i* of the first channel 21 is concentric with the second channel 22 in the first position 21*i*' of the first inlet 21*i*. Thus, in the first position 21*i*' of the first inlet 21*i*, the first channel is axially in line with the first portion of the outlet of the concentrating device. In the second position 21*i*" of the inlet 21*i* of the first channel 21*i*, the first channel 21 is eccentrically arranged within the second channel 22 and out of axial alignment with the first portion 25*o*1.

The actuator mechanism of the deflection device 24 comprises a linear motor 24*m*, which is controllable by the control unit. The motor 24*m* is fixed to the second channel 22 and indirectly connected to the first channel via a cable 24*c*, so as to drive the movement of the first channel 21 inside the second channel 22. The actuator mechanism comprises a transfer mechanism to convert the output movement of the motor 24*m* to the relative movement of the first channel 21. In this embodiment the transfer mechanism comprises the cable 24*c* and a cable guide 24*cg* fixed to the second channel 22. The cable 24*c* runs from the linear motor 24*m* to the first channel 21 via the cable guide 24*cg*. The cable 24*c* engages on the first channel 21 near the first inlet 21*i* to effectuate the pivoting movement. The linear output movement of the motor 24*m* is in the axial direction, indicated by the double arrow in FIG. 5*a*, and the cable guide 24*cg* guides the cable 24*c* to engage the first channel 21 in a radial direction, so that the operation of the linear motor 24*m* makes the cable 24*c* pull the first channel 21 in a radial direction. This pulling movement is indicated in FIG. 5*b* by the single arrow. The transfer mechanism further comprises an elastic element in the form of a spring 24*s*, diametrically opposite the radial location at which the cable 24*c* engages the first channel 21. It is fixed to both the first and second channel, such as to counteract a pulling action of the cable 24*c* by extending upon a movement of the inlet 21*i* towards the second position 21*i*", indicated by the double arrow in FIG. 5*b*, and contracting to effectuate the opposite movement. The actuator mechanism comprises two limiters 24*l*, which limit the movement range of the first channel 21 to the two positions shown in FIG. 5*b*.

In an alternative embodiment, shown in FIG. 6, the transfer mechanism comprises instead of the cable guide 24*cg* and the cable 24*c*, a channel wall guide 24*wg*. The motor 24*m* is not fixed to the cable 24*c* but to the channel wall guide 24*wg*. The channel wall guide 24*wg* cooperates with the outer wall of the first channel 21 for converting the output movement of the motor 24*m* to the pivoting movement of the first channel 21. The wall guide 24*wg* and the first channel wall engage at complementary slanted surfaces near the inlet 21*i* in the axial-radial direction, so that an axial movement by the motor 24*c* makes the slanted surfaces slide over one another, thereby inducing a radial movement component of the first channel 21, and therewith the pivoting movement around the pivot axis 24*p*. The spring 24*s* interconnects the first and second channel at the same radial location at which the channel wall guide 24*wg* engages the first channel 21, at some axial distance therefrom, to counteract the action of the motor 24*c*. The limiter 24*l*, limits the movement range of the first channel 21 in the radial direction, in addition to the wall guide 24*wg*.

The invention claimed is:

1. A method for directional drilling of a borehole with a borehole bottom, the method comprising:

providing a drill bit, said drill bit being connected to a lower end of a drill string and comprising:

a bit face, which during use faces the borehole bottom, one or more abrasive jet nozzles configured for directing a stream of drilling fluid mixed with abrasive particles into impingement with the borehole bottom in the form of an abrasive jet, which one or more abrasive jet nozzles, if in plural, are arranged at different adjacent azimuthal positions, an intermediate space between a bit fluid inlet port of the drill bit and said one or more abrasive jet nozzles, each of the one or more abrasive jet nozzles having a nozzle inlet for fluid communication with the intermediate space, from which each of the nozzle inlets extends;

upstream of said bit fluid inlet port, passing the stream of drilling fluid mixed with abrasive particles through a supply channel having an supply channel outlet at a substantially constant supply velocity, simultaneously, rotating the drill bit, and thereby the one or more abrasive jet nozzles, at a rotational velocity and passing said stream of drilling fluid mixed with abrasive particles via the supply channel outlet and the bit fluid inlet port consecutively through the intermediate space, the one or more nozzle inlets, and the one or more abrasive jet nozzles into impingement with the borehole bottom, so as to deepen the borehole; and during said rotating of the drill bit while passing of the stream of drilling fluid mixed with abrasive particles, varying concentrations of said abrasive particles along subsequent stream portions of said stream flowing through the abrasive jet nozzles of the drill bit, such that alternatingly the concentration of abrasive particles is high in a first stream portion and low in a subsequent second stream portion, wherein said varying of the concentrations of the abrasive particles in the stream of drilling fluid mixed with abrasive particles comprises:

upstream of said bit fluid inlet port, passing said stream from the supply channel outlet subsequently, in parallel through a first channel and a second channel to first and second outlets thereof, respectively, and from the first and second outlets into the bit fluid inlet port, while, alternatingly, during a first time period, deflecting into the first channel a majority of all abrasive particles in the stream that pass through the supply channel outlet, and during a second time period, following the first time period, not deflecting into the first channel a majority of all abrasive particles in the stream that pass through said supply channel outlet, and subsequently passing said stream from the first and second outlets into said one or more abrasive jet nozzles, wherein the difference between a flow resistance to said drilling fluid mixed with abrasive particles in said first channel and a flow resistance to said drilling fluid mixed with abrasive particles in said second channel results in a difference between a first velocity at which said drilling fluid mixed with abrasive particles flows through said first channel and a second velocity at which said drilling fluid mixed with abrasive particles flows through said second channel, wherein said difference between said first and second velocities is such that, downstream of the first and second outlets, the majority deflected into the first channel during the first time period and the abrasive particles passed into the second channel during the second time period, together with drilling fluid passed into the first and second channel during the first and second time period, respectively, are combined to form the first stream portion, and the abrasive particles passed into the first channel during the second time period and the abrasive particles passed into the second channel during a first time period following the second time period together with drilling fluid passed into the first and second channel during the second time period and a first time period following the second time period, respectively, are combined to form the second stream portion.

2. The method according to claim 1, wherein said varying of the concentrations of the abrasive particles in the stream of drilling fluid mixed with abrasive particles comprises:

during the first time period, deflecting into the first channel a first majority of all abrasive particles in the stream that pass through the supply channel outlet, and during the second time period following the first time period, deflecting into the second channel a second majority of all abrasive particles in the stream that pass through said supply channel outlet, and subsequently passing said stream from the first and second outlets into said one or more abrasive jet nozzles, wherein the difference between a flow resistance to said drilling fluid mixed with abrasive particles in said first channel and a flow resistance to said drilling fluid mixed with abrasive particles in said second channel results in a difference between a first velocity at which said first majority flows through said first channel and a second velocity at which said second majority flows through said second channel, wherein said difference between said first and second velocities is such that, downstream of the first and second outlets, the first and second majority deflected into the first channel during the first time period and deflected into the second channel during the second time period, together with drilling fluid passed into the first and second channel during the first and second time period, respectively, are combined to form the first stream portion, and minorities of abrasive particles not being deflected together with drilling fluid passed into the first and second channel during the second and first time period, respectively, are combined to form the second stream portion.

3. The method according to claim 1, wherein the first and second stream portions pass through the one or more abrasive jet nozzles at a frequency synchronized with a rotational velocity of the drill bit, and the first and second time periods are timed such that the first stream portion passes said abrasive jet nozzles while the abrasive jet nozzles are directed towards a selected angular sector of the borehole bottom, and the second stream portion passes said abrasive jet nozzles while the abrasive jet nozzles are not directed towards the selected angular sector of the borehole bottom.

4. The method Method according to claim 1, wherein the abrasive particles are magnetic abrasive particles, and the deflection into the first and second channel is achieved by alternatingly directing in the first and second time periods a magnetic field over a cross-section of the stream directly upstream of the first and second channel towards the first channel and towards the second channel, respectively, wherein the density of the magnetic field is higher in a part of the cross-section covering the first channel than in a part covering the second channel during the first time period, and higher in the part of the cross-section covering the second channel than in the part thereof covering the first channel during the second time period.

5. The method according to claim 1, wherein said difference between the flow resistance to said drilling fluid mixed with abrasive particles in said first channel and said second channel is established by a difference between said first and second channel in respective lengths thereof in the longitudinal direction, in respective cross sections thereof, in respective surface roughnesses of inner wall surfaces thereof, and/or in variations of the respective cross-sections and/or surface roughness of the inner wall surfaces thereof along said respective lengths thereof.

6. The method according to claim 5, wherein said difference between the flow resistance to said drilling fluid mixed with abrasive particles in said first channel and said second channel is established by a difference between said first and second channel in respective cross sections thereof, and wherein said respective lengths and surface roughness of inner wall surfaces and said variations therein along said respective lengths are equal to each other.

7. The method according to claim 1, wherein the drill bit is a mechanical drill bit further comprising one or more wash nozzles on the bit face, and said rotating of said drill bit involves mechanical cutting of the borehole bottom by said mechanical drill bit to deepen the borehole, the method further comprising, simultaneously with said impingement with the borehole bottom by said stream in the form of said abrasive jet, straining the abrasive particles in said first and second stream portions upstream of said abrasive jet nozzles and said wash nozzles, and deflecting the strained abrasive particles into the abrasive jet nozzles, while passing the drilling fluid in said first and second stream portions of the stream into both the abrasive jet nozzles and the wash nozzles.

8. The method according to claim 1, wherein the method further comprises a downhole recirculation of the abrasive particles passed through the abrasive jet nozzles into impingement with the borehole bottom, said downhole recirculation comprising:

capturing at least a part of the abrasive particles present in the stream downstream of said impingement thereof with the borehole bottom, and passing said captured abrasive particles into said stream upstream of said abrasive jet nozzles.

9. The method according to claim 1, wherein durations and/or timings of said first and second time period are set and/or adjusted, based on downhole measurements, including one or more of:

detection of abrasive particles downstream of said deflection thereof, detection of a position, at which said impingement with the borehole bottom takes place, detection of a geometrical direction of the deepening of the borehole.

10. The method according to claim 1, wherein the abrasive particles are magnetic abrasive particles, wherein the method further comprises:

activating a magnetic field in the first and/or second channel during a time interval such as to cause a local accumulation of magnetic abrasive particles in said first and/or second channel that results in a pressure pulse within that channel, and subsequently, deactivating said magnetic field, wherein said activation and deactivation are repeated to create a series of pressure pulses over time, of which the amplitudes and timings are determined such that said series of pressure pulses represents one of said downhole measurements for use in a mud pulse telemetry system.

11. A directional drilling system for directional drilling of a borehole with a borehole bottom, wherein the drilling system is connectable to a tubular drill string, the directional drilling system comprising:

a drill bit, comprising:

a bit face, which during use faces the borehole bottom, a bit fluid inlet port, one or more abrasive jet nozzles configured for ejecting a stream of drilling fluid mixed with abrasive particles into impingement with the borehole bottom in the form of an abrasive jet, which one or more abrasive jet nozzles, if in plural, are arranged at different azimuthal positions, and an intermediate space between the bit fluid inlet port and said one or more abrasive jet nozzles, each of the one or more abrasive jet nozzles having a nozzle inlet for fluid communication with the intermediate space, from which each of the nozzle inlets extends; and a sub, connected at a downhole end thereof to the drill bit, and at another end thereof to the tubular drill string, the sub comprising:

a sub fluid inlet port, fluidly connected to a supply channel through the drill string to receive from said supply channel the stream of drilling fluid mixed with abrasive particles when the system is connected to the drill string, and a sub fluid outlet port, fluidly connected to the bit fluid inlet port, wherein the sub further comprises, fluidly connected to the sub fluid inlet port, downstream thereof, a modulation unit configured to cause a variation of a concentration of abrasive particles along stream portions of the stream received from the supply channel that are subsequently passed through the sub fluid outlet port into the bit fluid inlet port, the modulation unit comprising:

a first channel having a first flow resistance to the drilling fluid mixed with abrasive particles, a first inlet, and a first outlet fluidly connected to the sub fluid outlet port, a second channel arranged in parallel to the first channel, having a second flow resistance to the drilling fluid mixed with abrasive particles, a second inlet, and a second outlet fluidly connected to the sub fluid outlet port (20*o*), a particle deflection device between the sub fluid inlet port and the first and second inlets, comprising one or more actuators, and being connected to a control unit of the system, wherein the particle deflection device is configured to periodically, during a first time period, deflect into the first inlet a majority of all abrasive particles received from the supply channel through the sub bit fluid inlet port, and during a second time period following the first time period, not deflect into the first inlet a majority of all abrasive particles in the stream received from the supply channel through the sub bit fluid inlet port, wherein the first and second channel are embodied such that a difference between the first flow resistance and the second flow resistance results in a velocity difference between said drilling fluid mixed with abrasive particles passing through said first channel and said drilling fluid mixed with abrasive particles passing through said second channel, wherein said velocity difference is such that in a combination section downstream of the first and second outlets, the majority deflected into the first inlet during the first time period and the abrasive particles passed into the second inlet during the second time period, together with any of said drilling fluid passed into the first and second inlet during the first and second time period, respectively, are combined into one of said stream portions, and abrasive particles passed into the first inlet during the second time period and abrasive particles passed into the second inlet during a first time period following the second time period, together with any drilling fluid passed into the first inlet during the second time period and into the second inlet during a first time period following the second time period, respectively, into a subsequent one of said stream portions.

12. The directional drilling system according to claim 11, wherein the control unit and the particle deflection device are configured to during a first time period, deflect into the first channel a first majority of all abrasive particles in the stream that passes through the supply channel outlet, and during a second time period following the first time period, deflect into the second channel a second majority of all abrasive particles in the stream that passes through said supply channel outlet, and subsequently passing said stream from the first and second outlets into said one or more abrasive jet nozzles, wherein said velocity difference is such that in a combination section downstream of the first and second outlets, the majority deflected into the first channel during the first time period and the second majority passed into the second inlet during the second time period, together with any of said drilling fluid passed into the first and second inlets during the first and second time period, respectively, are combined into one of said stream portions, and abrasive particles passed into the first inlet during the second time period and the abrasive particles passed into the second inlet during a first time period following the second time period, together with any drilling fluid passed into the first inlet during the second time period and into the second inlet during the first time period following the second time period, respectively, into a subsequent one of said stream portions.

13. The directional drilling system according to claim 12, wherein the control unit is configured such that the signals thereof received by the particle deflection device cause the time periods in which the actuators of the particle deflection device deflect said first and second majority of the abrasive particles into the first and second channel to be synchronized with the rotational velocity of the drill bit, and to be timed such, that said one of said stream portions passes through the one or more abrasive jet nozzles while the abrasive jet nozzles are directed towards a selected angular sector of the borehole bottom, together with any of said drilling fluid passed into the first and second channel during the first and second time period, respectively, and said subsequent one of said stream portions passes through the one or more abrasive jet nozzles while the abrasive jet nozzles are not directed towards said selected angular sector of the borehole bottom.

14. The directional drilling system according to claim 11, wherein the abrasive particles are magnetic abrasive particles, and the actuators of the particle deflection device comprise a magnetic switch, which is configured to during the first time period establish an inhomogeneous magnetic field over a cross-section directly upstream of the first and second inlets that in the plane of said cross-section directs the abrasive particles towards the first inlet and to during the second period establish an inhomogeneous magnetic field over a cross-section directly upstream of the first and second inlets that in the plane of said cross-section directs the abrasive particles towards the second inlet, wherein the density of the magnetic field produced in the first time period is higher in a part of the cross-section covering the first channel than in a part thereof covering the second channel, and the density of the magnetic field produced in the second time period is higher in the part of the cross-section covering the second channel than in the part thereof covering the first channel.

15. The directional drilling system according to claim 14, wherein the magnets are movable permanent magnets, and the actuators further comprise drive means, connected to the magnets and configured to move, based on the signals received from the control unit, the magnets as a unity along the circumference upon a switch between the respective time periods to establish that said magnetic fields direct the abrasive particles towards the respective channels during the respective time periods.

16. The directional drilling system according to claim 11, wherein said difference between the flow resistance to said drilling fluid mixed with abrasive particles in said first channel and said second channel is established by a difference between said first and second channel in respective lengths thereof in the longitudinal direction, in respective cross-sections thereof, in respective surface roughnesses of inner wall surfaces thereof, and/or in variations of the respective cross sections and/or surface roughness of the inner wall surfaces thereof along said respective lengths thereof.

17. The directional drilling system according to claim 15, wherein said difference between the flow resistance to said drilling fluid mixed with abrasive particles in said first channel and said second channel is established by a difference between said first and second channel in respective cross-sections thereof, said respective lengths and surface roughnesses of inner wall surfaces and said variations therein along said respective lengths being equal to each other.

18. The directional drilling system according to claim 11, wherein the drill bit is an abrasive jet drill bit, wherein the bit face is devoid of any wash nozzles and mechanical cutters.

19. The directional drilling system according to claim 11, wherein the drill bit is a mechanical drill bit, further comprising:

one or more mechanical cutters, arranged on the bit face, one or more wash nozzles arranged at respective adjacent azimuthal positions different from those of the one or more abrasive jet nozzles, a strainer, arranged inside the intermediate space of the drill bit and rotating along with the drill bit, configured to direct the abrasive particles in said stream as received through the bit fluid inlet port into the abrasive jet nozzles, while passing drilling fluid within said stream into both the abrasive jet nozzles and the wash nozzles.

20. The directional drilling system according to claim 11, wherein the abrasive particles are magnetic abrasive particles, the system further comprising a downhole recirculation unit for recirculation of the abrasive particles passed through the abrasive jet nozzles into impingement with the borehole bottom, said downhole recirculation unit comprising one or more magnets arranged such that one or more magnetic fields produced thereby attract abrasive particles from the stream downstream of said impingement thereof with the borehole bottom, and convey the attracted particles in a recirculation stream at a substantially constant flow rate to a mixing section through which said stream passes upstream of said abrasive jet nozzles.

21. The directional drilling system according to claim 11, comprising one or more sensors, including one or more of:

one or more positional sensors, arranged on or directly above the drill bit, wherein the one or more positional sensors are configured to provide a signal to the control unit indicative of the position, at which said impingement of the stream with the borehole bottom takes place, one or more presence detection sensors, sensors, arranged at a location downstream of said deflection device, configured to provide a signal to the control unit indicative of the presence of abrasive particles at said location, one or more navigational sensors, arranged on or directly above the drill bit, wherein the one or more positional sensors are configured to provide a signal to the control unit indicative of a geometrical direction of said deepening of the borehole, the control unit being configured to, based on signals of the sensors, control the actuators of the particle deflection device.

22. The directional drilling system according to claim 21, wherein the abrasive particles are magnetic abrasive particles, the system further comprising a mud pulse telemetry unit, comprising:

a telemetric control unit, configured to receive one or more of said signals provided by one or more of said sensors and encode these into series of pulses with predetermined timings and amplitudes, a switchable magnet arranged such as to produce in the first and/or second channel a magnetic field, configured to during activation thereof, cause a local accumulation of the magnetic abrasive particles in said first and/or second channel that results in a pressure pulse within that channel, and upon deactivation thereof, stops said causing of said local accumulation, wherein said telemetric control unit is configured to control the activation and deactivation of the switchable magnet such that the switchable magnet repeatedly produces said pressure pulse to form a series of pressure pulses of which the timings and amplitudes correspond to said encoded series of pulses, wherein said control unit is configured to decode said corresponding signals produced by said conversion device into the values of the quantities measured by said one or more sensors, to compare said values with a predetermined reference value of said quantity, and to provide in dependence of the result of said comparing, said control signals to the particle deflection device.

23. A steerable sub for use in a directional drilling system, connectable at a downhole end thereof to a drill bit of the system, and at another end thereof to a tubular drill string of the system, comprising:

a sub fluid inlet port, fluidly connectable to a supply channel through the tubular drill string, to receive from the supply channel a stream of drilling fluid mixed with abrasive particles from the supply channel when the sub is connected to the drill string, and a sub fluid outlet port, fluidly connectable to the bit fluid inlet port, to pass to the drill bit said stream when the sub is connected to the drill bit, a modulation unit configured to cause a variation of a concentration of abrasive particles along stream portions of the stream received from the supply channel, the modulation unit being fluidly connected to the sub fluid inlet port, downstream thereof, the modulation unit comprising:

a first channel having a first flow resistance to the drilling fluid mixed with abrasive particles, a first inlet, and a first outlet fluidly connected to the sub fluid outlet port, a second channel arranged in parallel to the first channel, having a second flow resistance to the drilling fluid mixed with abrasive particles, a second inlet, and a second outlet fluidly connected to the sub fluid outlet port, a particle deflection device arranged at a location along the stream between the sub fluid inlet port and the first and second inlets, comprising one or more actuators connectable to a control unit, wherein the particle deflection device is configured to periodically, during a first time period, deflect a first majority of all abrasive particles received from the supply channel through the sub fluid inlet port into the first inlet, and during a second time period following the first time period, deflect a second majority of all abrasive particles in the stream received from the supply channel through the sub fluid inlet port into the second inlet, wherein the first and second channel are embodied such that a difference between the first flow resistance and the second flow resistance results in a velocity difference between said first majority of abrasive particles passing through said first channel and said second majority of abrasive particles passing through said second channel, wherein said velocity difference is such that in a combination section downstream of the first and second outlets, the first and second majority, together with any of said drilling fluid passed into the first and second channel during the first and second time period, respectively, are combined into one of said stream portions, and minorities of abrasive particles not being deflected, together with any drilling fluid passed into the first and second channel during the second and first time period, respectively, into a subsequent one of said stream portions.

24. An abrasive particle pulse generator for use in a directional drilling system, configured to cause a variation of a concentration of abrasive particles along stream portions of a stream of abrasive particles mixed with drilling fluid to be passed through one or more abrasive nozzles of the system, the pulse generator comprising:

a first channel having a first flow resistance to the drilling fluid mixed with abrasive particles, a first inlet, and a first outlet, a second channel arranged in parallel to the first channel, having a second flow resistance to the drilling fluid mixed with abrasive particles, a second inlet, and a second outlet, a particle deflection device, arranged at a location along the stream directly upstream of the first and second inlets, comprising one or more actuators connected to a control unit, wherein the particle deflection device is configured to periodically, during a first time period, deflect a first majority of all abrasive particles of the stream passing said location into the first inlet, and during a second time period following the first time period, deflect a second majority of all abrasive particles in the stream passing said location into the second inlet, wherein the first and second channel are embodied such that a difference between the first flow resistance and the second flow resistance results in a velocity difference between said first majority of abrasive particles passing through said first channel and said second majority of abrasive particles passing through said second channel, wherein the velocity difference is such that in a combination section downstream of the first and second outlets, the first and second majority, together with any of said drilling fluid passed into the first and second inlet during the first and second time period, respectively, are combined into one of said stream portions, and minorities of abrasive particles not being deflected, together with any drilling fluid passed into the first and second channel during the second and first time period, respectively, are combined into a subsequent one of said stream portions.

* * * * *